US005882127A

United States Patent [19]

Amano

[11] Patent Number: 5,882,127

[45] Date of Patent: Mar. 16, 1999

[54] CARD PRINTER AND METHOD OF PRINTING ON CARDS USING THE SAME

[75] Inventor: Toshio Amano, Kyoto, Japan

[73] Assignee: Rohm Co. Ltd., Kyoto, Japan

[21] Appl. No.: 913,386

[22] PCT Filed: Mar. 15, 1996

[86] PCT No.: PCT/JP96/00716

§ 371 Date: Sep. 15, 1997

§ 102(e) Date: Sep. 15, 1997

[87] PCT Pub. No.: WO96/28303

PCT Pub. Date: Sep. 19, 1996

[30] Foreign Application Priority Data

| | | | |
|---|---|---|---|
| Mar. 16, 1995 | [JP] | Japan | 7-057722 |
| Mar. 27, 1995 | [JP] | Japan | 7-068203 |
| Apr. 14, 1995 | [JP] | Japan | 7-089062 |

[51] Int. Cl.[6] ..... B41J 13/12

[52] U.S. Cl. ..... 400/521; 400/525; 400/632

[58] Field of Search ..... 400/120.01, 521, 400/525, 535, 536, 537, 632, 622

[56] References Cited

U.S. PATENT DOCUMENTS

| | | | |
|---|---|---|---|
| 5,326,179 | 7/1994 | Fuakai et al. | 400/521 |
| 5,516,218 | 5/1996 | Amano et al. | 400/521 |
| 5,667,316 | 9/1997 | Nardone et al. | 400/525 |

FOREIGN PATENT DOCUMENTS

| | | | |
|---|---|---|---|
| 48-19673 | 6/1973 | Japan . | |
| 57-27840 | 2/1982 | Japan | B65H 3/06 |
| 57-124840 | 8/1982 | Japan | G03B 27/62 |
| 59-5080 | 1/1984 | Japan | B41J 13/10 |
| 59-61138 | 4/1984 | Japan | B65H 3/52 |
| 60-92886 | 5/1985 | Japan | B41J 29/00 |
| 61-72536 | 5/1986 | Japan | B65H 3/06 |
| 61-89869 | 5/1986 | Japan | B41J 3/20 |
| 61-257838 | 11/1986 | Japan | B65H 3/04 |
| 62-58652 | 4/1987 | Japan | B41J 13/22 |
| 62-280140 | 12/1987 | Japan | B65H 3/52 |
| 63-130294 | 8/1988 | Japan | B43L 13/00 |
| 2-249669 | 10/1990 | Japan | B41J 13/00 |
| 3-166975 | 7/1991 | Japan | B41J 17/38 |
| 4-35970 | 2/1992 | Japan | B41J 13/00 |
| 4-86284 | 3/1992 | Japan | B41M 5/26 |
| 4-156375 | 5/1992 | Japan | B41J 25/312 |
| 4-100876 | 9/1992 | Japan | B41J 25/312 |
| 4-278379 | 10/1992 | Japan | B41J 25/312 |
| 5-57923 | 3/1993 | Japan | B41J 2/325 |
| 5-229199 | 9/1993 | Japan | B41J 13/02 |
| 7-164660 | 6/1995 | Japan | B41J 2/325 |

*Primary Examiner*—John Hilten

*Attorney, Agent, or Firm*—Michael D. Bednarek; Kilpatrick Stockton LLP

[57] ABSTRACT

A card printer includes a card supply mechanism (20) for forwardly feeding cards one after another from a stack thereof held by a card stocker (21), a card carrier table (20) having an upper surface for supporting each of the cards fed from the card supply mechanism (20). The card carrier table is reciprocatively movable forwardly and rearwardly. The card printer further includes a printhead (90') located above the card carrier table (60). The printhead selectively assumes a position contacting each card on the card carrier table (60) via an ink ribbon (R) and a position upwardly spaced from the card. The card printer further includes a card discharge mechanism (120) for picking up a printed card from the card carrier table (60) moved to a forward position and for discharging the printed card. The card supply mechanism (20) includes an initial feed roller (31) for forwardly feeding the cards one after another from the card stocker (21) accommodating the stacked cards, and a plurality of intermediate feed rollers (36, 37) arranged ahead of the initial feed roller (31) to face a card transfer path from above and below. Part or all of the intermediate feed rollers (36, 37) are movable transversely of the card transfer path and urged toward the card transfer path.

22 Claims, 22 Drawing Sheets

CARD PRINTER AND METHOD OF PRINTING ON CARDS USING THE SAME

TECHNICAL FIELD

The present invention relates to a card printer capable of impressing a color print on the surface of various cards, and a method of printing on cards using such a card printer.

BACKGROUND ART

Recently, various kinds of cards such as ID cards, credit cards, security cards, members cards, cash cards and the like have become available for identification of individuals engaged in dealings. These cards are all standardized to have the same size for example for the convenience of users carrying various cards with them. In view of this, there is a plan in progress for equalizing the size of e.g. driver's licenses to the above standardized size. Further, there is also a plan to equalize the size of employee identification cards issued by companies or student identification cards issued by schools to the above standardized size.

In currently available credit cards and cash cards, part of the symbols and letters carrying information should be physically raised from the card surface by embossing for example. To this end, those cards are formed by a material made of polyethylene for example and having a large thickness. However, in cards such as a prepaid card or a telephone card where magnetized information alone is important for its function, the card thickness is rendered rather small.

As for cards formed by a currently rather thick card material, it is possible that they will also be formed by a thin card material like in e.g. a telephone card for the purposes of rendering them much easier to carry.

In cards used for identifying individuals or proving the background of individuals, it is necessary to render each card to carry individual information. As for ID cards, driver's licenses, employee identification cards or student identification cards, each card needs to carry a photograph of the owner's face. Therefore, printing on these cards cannot be performed by a printing machine designed for impressing a same print on a large lot basis.

Color printing techniques performed in accordance with electronic information of color images includes a technique in which a sublimation type ink ribbon is used, and printing operations are performed by using a thermal printhead to impress yellow, magenta and cyanine, and if necessary black, in this order in an overlapping manner. (See Japanese Patent Application Laid-open No. 61-43871, Japanese Utility Model Application Laid-open No. 60-5856 and Japanese Patent Application Laid-open No. 62-11370 for example.) According to such a technique, various color images are properly printed by changing the color image information. (Hereinafter, the above colors may be merely referred to as Y, M, C and B, respectively.)

However, according to the techniques disclosed in Japanese Patent Application Laid-open No. 61-43871 or Japanese Utility Model Application Laid-open No. 60-5856, color printing is possible for thin sheets but not for cards. On the other hand, Japanese Patent Application Laid-open No. 62-11370 touches upon the idea of impressing a color print on cards. However, this document completely fails to disclose specific arrangements about a successive card feed mechanism, a card retaining mechanism during the printing operation, a card discharge mechanism after the printing operations and the like. These mechanisms are essential in practice for constructing a printer impressing color prints on cards. Therefore, without them, it is utterly impossible to put the above-mentioned idea into practice. It is also impossible to properly impress a color print on various cards differing in thickness as described above.

Thus, it is an object of the present invention to provide a card printer properly impressing a color print on various cards differing in thickness and material.

Another object of the present invention is to provide a card printer impressing a color print substantially on an entire surface of cards, and a method of printing on cards using the same printer.

DISCLOSURE OF THE INVENTION

According to a first aspect of the present invention, there is provided a card printer comprising:

a card supply mechanism for forwardly feeding cards one after another from a stack thereof held by a card stocker;

a card carrier table having an upper surface for supporting each of the cards fed from the card supply mechanism, the card carrier table being reciprocatively movable forwardly and rearwardly;

a printhead located above the card carrier table, the printhead selectively assuming a position contacting said each card on the card carrier table via an ink ribbon and a position upwardly spaced from said each card; and a card discharge mechanism for picking up a printed card from the card carrier table moved to a forward position and for discharging the printed card.

The card supply mechanism includes an initial feed roller for forwardly feeding the cards one after another from the card stocker accommodating the stacked cards, and a plurality of intermediate feed rollers arranged ahead of the initial feed roller to face a card transfer path from above and below. Part or all of the intermediate feed rollers are movable transversely of the card transfer path and urged toward the card transfer path.

The initial feed roller contacts the uppermost or lowest card of the stacked cards held within the card stocker, and rotates in this state to feed the contacted card forward. Then, the card fed forward from the card stocker is further moved forward by the contact of the intermediate feed rollers. According to the present invention, the intermediate rollers are movable transversely of the card transfer path depending on the card thickness. Thus, it is possible to feed each card while the intermediate feed rollers properly contact the card. Therefore, even when the thickness of the cards is varied within predetermined limits, each card is properly fed forward and transferred onto the card carrier table.

The card carrier table, whose upper surface is now supporting thus transferred card, is reciprocated forwardly and rearwardly a predetermined number of times. A print may be impressed by the printhead contacting the card, when the card carrier table is moved from a rearward position to a forward position for example. For color printing, four colors, or Y, M, C, and, if necessary, B may be applied in an overlapping manner. Thus, a printing operation using the card carrier table together with the printhead is repeated three or four times. When the printing is completed, the card carrier table is at the above-mentioned forward position. Further, the printed card is picked up from the card carrier table by the card discharge mechanism, and then discharged from the printer by using e.g. a feed roller designed to contact the card.

Further, according to a preferred embodiment, the stacked cards accommodated within the card stocker are constantly urged upward, and the initial feed roller is designed to contact a surface of the uppermost card of the stacked cards. When the initial feed roller rotates, the uppermost card is fed forwardly.

With such an arrangement, even when the thickness of the stacked cards within the card stocker is varied, the uppermost card is always held in contact with the initial feed roller by a uniform elastic force. Therefore, even when the thickness of the cards to be used is varied within a predetermined range, each card is properly fed forward from the stocker and transferred onto the card carrier table. This means that an object of the present invention, that is, that proper printing is performed on various cards differing in thickness, is achieved in the card supply mechanism.

Further, in the preferred embodiment, the intermediate feed rollers provided ahead of the initial feed roller are disposed at two positions which are located above the card transfer path and spaced to each other in a front-rear direction. The intermediate feed rollers are respectively mounted on front and rear portions of a second arm which is pivotally supported at an intermediate portion thereof by a suitable portion of a first arm pivotally supported by a frame and urged downward.

With such an arrangement, an equalizer function is attained by equally urging the intermediate feed rollers supported at front and rear portions of the second arm. As a card fed from the card stocker by the initial feed roller is being moved forward along the transfer path, first the rear intermediate feed roller rides over the leading edge of the card and then the front intermediate feed roller rides over the leading edge of the card. Even in this movement, an unduly strong force is prevented from acting on the leading edge when the leading edge is ridden over, since the elastic pressing force by the respective intermediate feed rollers is equalized. Further, when the two rollers at the front and rear portions are simultaneously held in contact with the card being transferred, the pressing force toward the card surface due to the respective rollers is equalized. As a result, a card transfer operation is smoothly performed, causing no stalling of cards for example.

Further, in the preferred embodiment, the card supply mechanism is arranged so that no forward feed driving force is given to the initial feed roller after a card fed by the initial feed roller is released from the initial feed roller.

Such an arrangement enables prevention of improper card feeding in which the card stacked immediately under the uppermost card is dragged forward by the uppermost card.

Further, in the preferred embodiment, the initial feed roller is supported for forward one-way rotation by a feed roller shaft to which forward and reverse rotational driving forces are given. The feed roller shaft has an end provided with a forward one-way gear and an adjacent reverse one-way gear. The card feed mechanism includes an idle gear held in mesh with the forward one-way gear, an intermediate transmission shaft carrying an intermediate transmission gear held in mesh with both the idle gear and the reverse one-way gear, pulleys attached to roller shafts carrying the respective intermediate feed rollers provided at said two positions, a pulley mounted on the intermediate transmission shaft, and an endless belt held in engagement with the above pulleys so that the respective pulleys rotate in a same direction.

In this regard, the forward one-way gear is described as a gear to which forward rotational driving force of the feed roller shaft is transmitted and which rotates together with the feed roller shaft, whereas the reverse one-way gear is described as a gear to which reverse rotational driving force of the feed roller shaft is transmitted and which rotates together with the feed roller shaft.

With such an arrangement, first the initial feed roller is rotated in the forward direction due to the forward rotational driving force given to the feed roller shaft, and then the uppermost card within the card stocker is fed forward. At this time, the intermediate feed rollers are rotated in the forward direction via the forward one-way gear, the idle gear, the intermediate transmission gear and the endless belt, and feed much forward the card which has been already fed forward by the feed roller and arrived at the intermediate feed rollers. This is possible because the intermediate transmission gear is rotated in the same forward direction as in the forward one-way gear since the idle gear is present between the intermediate transmission gear and the forward one-way gear. The reverse one-way gear is rotated in a direction opposite to the rotational direction of the forward one-way gear since the intermediate transmission gear is also held in mesh with the reverse one-way gear. However, the reverse one-way gear is freely rotated in the reverse direction to the rotational direction of the feed roller shaft rotating in the forward direction, without hindering transmission of driving force.

When the card is fed forward by a predetermined distance by the intermediate feed rollers, or more specifically, when the trailing edge of the card leaves the initial feed roller, the rotational direction of the feed roller shaft is changed from the forward direction to the reverse direction. Since the initial feed roller is supported by the feed roller shaft for forward one-way rotation, the feed roller shaft is freely rotated in the opposite direction to the feed roller. In this way, the feed roller remains motionless even though the roller shaft is rotated in the opposite direction. Therefore, the next card to be held in pressing contact with the feed roller is prevented from being successively fed forward.

The reverse driving force of the feed roller shaft is transmitted to the reverse one-way gear and then to the intermediate transmission gear. These two gears are not associated via any idle gears but held in direct mesh with each other. Thus, the intermediate transmission gear is rotated oppositely to the reverse one-way gear, that is, in the forward direction. Therefore, even when the feed roller shaft is rotated in the reverse direction, the intermediate transmission gear and the respective intermediate feed rollers continue to be rotated in the forward direction, thereby continuously feeding the card much forward. As a result, the card supply mechanism reliably causes each of the cards in the card stocker to be fed forward successively, without dragging the next card, and placed onto the card carrier table.

Further, in the preferred embodiment, in the card supply mechanism, a predetermined frictional resistance is given between the feed roller and the feed roller shaft carrying the feed roller for forward one-way rotation.

With such an arrangement, it is possible to give weak reverse driving force to the feed roller when the feed roller shaft is reversely rotated. Thus, erroneous supply of the next card is more reliably prevented.

Further, in the preferred embodiment, the card supply mechanism further includes a reverse gear held in mesh with the idle gear and a reverse roller mounted on a reverse shaft supporting the reverse gear for rotational movement with a predetermined frictional resistance. The reverse roller is arranged below the transfer path to contact a lower surface of a card fed along the transfer path.

With such an arrangement, even if the next card adhered to the lower surface of the card intended to be fed is transferred, the next card is returned by the reverse roller back to the card stocker. Thus, it is possible to more reliably prevent the erroneous card feeding where a plurality of stacked cards are placed onto the card carrier table.

According to a second aspect of the present invention, there is provided a card printer comprising:

a card supply mechanism for forwardly feeding cards one after another from a stack thereof held by a card stocker;

a card carrier table having an upper surface for supporting each of the cards fed from the card supply mechanism, the card carrier table being reciprocatively movable forwardly and rearwardly;

a printhead located above the card carrier table, the printhead selectively assuming a position contacting said each card on the card carrier table via an ink ribbon and a position upwardly spaced from said each card; and a card discharge mechanism for picking up a printed card from the card carrier table moved to a forward position and for discharging the printed card.

The printhead is attached to a printhead support member movable in an up-down direction. The printhead support member is arranged to urge the printhead toward said each card by downward elastic force when the support member descends.

When the forwardly and rearwardly reciprocative card carrier table is moved forward for example, the printhead is held in contact with the card on the card carrier table via the ink ribbon. In this state, the ink of the ink ribbon is thermally transferred to the card surface to impress a print in each color. In performing color printing, such an operation is repeated tree times for printing Y, M and C, or four times for printing these colors plus B. In the card printer having the above arrangement, the printhead is supported by a vertically movable printhead support member. The printhead support member is arranged to press the printhead toward the card by downward elastic force when it is lowered.

In a preferred embodiment, the printhead support member supported for vertical pivot is urged downward basically by a spring. The printhead support member is moved in an up-down direction by suitably rotating a rotation cam having different radial lengths measured to its cam surface. Due to this rotation the cam is caused to come into contact with a suitable portion of the printhead support member. When the printhead is desired to be held in contact with the card on the card carrier table, the rotation cam is spaced from the printhead support member so that the printhead is elastically held in contact with the card surface. In this manner, the printhead is held in contact with the card surface under a proper pressing force, even when the card is a thick card such as a cash card made of polyethylene for example, or a rather thin card such as a telephone card, or a card thin enough to be referred to as a sheet. Thus, it is possible to perform proper printing regardless of the kinds of the cards.

In the preferred embodiment, the printhead support member is provided with a ribbon guide roller for guiding an ink ribbon after the ink ribbon passes a head surface of the printhead.

With such an arrangement, detachment of the ink ribbon from the card surface is properly performed when the printhead is lifted up, since the ribbon guide roller is mounted on the vertically movable printhead support member. In addition, it is possible to prevent the ink ribbon from slacking or being wastefully fed, thereby attaining effective utilization of the ink ribbon.

Further, in the preferred embodiment, the printhead support member or the printhead is mounted on an open-close member. The ribbon guide roller is supported by a bracket attached to a chassis frame for vertical movement by a predetermined distance. The printhead support member is formed with a hook member held in snapping engagement with the ribbon guide roller when the open-close member is closed, so that the ribbon guide roller is held at a predetermined position relative to the printhead support member.

With such an arrangement, it is possible to mount the ribbon cartridge as desired when the open-close member is open. On the other band, when the open-close member is closed, the ribbon guide roller is automatically attached to the printhead support member as described above. In particular, it is possible to enjoy the above advantages obtained by providing the ribbon guide roller, while the manageability in changing ink ribbon cartridges is maintained.

Further, in the preferred embodiment, in a case where the ink ribbon is fed from a rear side of the printhead to a front side of the printhead, the printhead support member is formed with a front wall ahead of the printhead. The ribbon guide roller is arranged to come into engagement with the ink ribbon after the ink ribbon passes the head surface of the printhead and moves upward along the front wall. In addition, a photosensor is provided in facing relation to the front wall of the printhead support member for detection of a marker formed on the ink ribbon.

With such an arrangement, it is possible for the photosensor to detect the marker on the ink ribbon at a proper distance, while the printhead support member is still movable in an up-down direction. This is because the front wall of the vertically movable printhead support member and the photosensor are arranged in facing relation in a front-rear direction. Further, it is possible to bring the ink ribbon to the starting point for each printing operation without wasting the ribbon, since the marker on the ink ribbon is detected immediately after it passes the head surface of the printhead. This means that the longitudinal length of each color region on the ink ribbon is rendered as small as possible. Thus, effective utilization of the ink ribbon is possible.

According to a third aspect of the present invention, there is provided a card printer comprising:

a card supply mechanism for forwardly feeding cards one after another from a stack thereof held by a card stocker;

a card carrier table having an upper surface for supporting each of the cards fed from the card supply mechanism, the card carrier table being reciprocatively movable forwardly and rearwardly;

a printhead located above the card carrier table, the printhead selectively assuming a position contacting said each card on the card carrier table via an ink ribbon and a position upwardly spaced from said each card; and a card discharge mechanism for picking up a printed card from the card carrier table moved to a forward position and for discharging the printed cards.

The printhead is attached to a printhead support member movable in an up-down direction. The printhead is pivotable laterally for coming into uniformly pressing contact with said each card on the card carrier table via an entire lateral length of the printhead.

In a preferred embodiment, the printhead support member is formed with a forwardly extending arm portion torsionally deformable in an elastic manner to allow the printhead to pivot laterally.

Further, in the preferred embodiment, the printhead is carried by the printhead support member for pivotal movement about an axis extending in a front-rear direction.

With such an arrangement, the entire lateral length of the printhead is held in contact with the card surface under proper pressing force, even when the cards differ in material or thickness, or the lateral orientation of the card carrier table deviates from the horizontal line. Thus, the printing quality is maintained at a high level.

As described above, the lateral pivotal movement of the printhead is achieved by rendering the arm portion of the printhead support member torsionally deformable. Alternatively, it is also possible to support the printhead by the printhead support member for pivotal movement about an axis extending in a front-rear direction.

According to a fourth aspect of the present invention, there is provided a card printer comprising:

a card supply mechanism for forwardly feeding cards one after another from a stack thereof held by a card stocker;

a card carrier table having an upper surface for supporting each of the cards fed from the card supply mechanism, the card carrier table being reciprocatively movable forwardly and rearwardly;

a printhead located above the card carrier table, the printhead selectively assuming a position contacting said each card on the card carrier table via an ink ribbon and a position upwardly spaced from said each card; and a card discharge mechanism for picking up a printed card from the card carrier table moved to a forward position and for discharging the printed card.

The card carrier table is provided with clamping means for positioning said each card fed from the card supply mechanism by contacting a leading edge of said each card. The clamping means selectively assumes a clamping position to clamp the leading edge of the card and a non-clamping position by moving forward away from the clamping position.

When the card carrier table, which is reciprocative forwardly and rearwardly, is moved forward for example, the printhead is held in contact with the card on the card carrier table via the ink ribbon. In this state, the ink of the ink ribbon is thermally transferred to the card surface to impress a print in each color.

In performing color printing, such an operation is repeated tree times for printing Y, M and C, or four times for printing these colors and B. In order to properly perform such color printing operations in an overlapping manner, the card should be held in place on the card carrier table. In the card printer according to the present invention, part of such card holding function is achieved by the clamping means described above. Basically, the clamping means is for pinching the leading edge of the card between clamp claws and the card carrier table. Thus, it is possible to properly and reliably retain the card on the card carrier table in spite of friction generated during the printing operation by the printhead. This leads to improvement of color printing quality.

As described above, according to the fourth aspect of the present invention, the clamping means selectively assumes a clamping position to pinch the leading edge of the card and a non-clamping position where the clamping means leaves the clamping position by moving forwardly. This means that the card or sheet is properly held in place by the leading edge pinched between the clamp claws and the card carrier table, regardless of the card thickness as long as the card thickness falls within a predetermined range. Thus, in the card printer according to the fourth aspect of the present invention, the object that proper printing is performed on cards differing in thickness is achieved by the card carrier table.

Further, the clamping means at the card carrier table selectively assumes the non-clamping position. The clamp claws are moved forward away from the leading edge of the card in the non-clamping position. Then, the printhead can come into contact with the leading edge of the card. Therefore, with such an arrangement that causes the clamping means to assume the non-clamping position only when the printhead contacts the leading edge of the card, a print can be impressed on the entire surface of the card, from its front to the rear, during the forward movement of the card carrier table.

In a preferred embodiment, the card printer further includes a pressing roller arranged behind the printhead. The pressing roller selectively assumes a position for pressing a rear portion of the upper surface of the card on the card carrier table, and a position upwardly spaced from the card.

With such an arrangement, when the card carrier table is moved to a forward position or a rearward position, the leading edge or a rear portion of the card is always retained physically by the clamping means or the pressing roller. In this way, it is possible to prevent positional deviation of the card relative to the card carrier table. As a result, a print is properly impressed on the entire card surface.

Further, in the preferred embodiment, the card carrier table further includes card lifting means for lifting the leading edge of the printed card from the carrier table by the projection of the lifting means from the carrier table when the carrier table is moved to a forward position after a printing operation is completed. On the other hand, the card discharge mechanism includes pick-up means having a scooping member for picking up the printed card from the card carrier table in a manner such that the scooping member is moved forward after the scooping member is inserted between the leading edge of the printed card and the upper surface of the card carrier table. The leading edge of the printed card is lifted up by the card lifting means on the card carrier table when the card carrier table is moved to the forward position. The card discharge mechanism also includes transfer-discharge means for carrying forward the picked up card and for discharging the card.

With such an arrangement, it is possible to transfer the printed card for discharge, while the leading edge of the card is being picked up. Thus, the displacement of the card carrier table is prevented from becoming unduly large. As a result, it is possible to simplify the card discharge mechanism and make the printer as a whole compact.

According to a fifth aspect of the present invention, there is provided a method of printing on cards using the card printer according to the fourth aspect of the present invention. In the method, thick cards are used, and the card carrier table retaining each card on the upper surface of the table is reciprocated forwardly and rearwardly. The method includes the steps of: impressing a print on said each card from the leading edge toward a trailing edge of said each card with the printhead held in contact with said each card via the ink ribbon when the card carrier table is moved forward; keeping the printhead away from said each card when the card carrier table is moved backward; and repeating the above two steps a plurality of times for successively impressing a print in Y(yellow), M(magenta) and C(cyanine), and, if necessary, B(black). The clamping means moves forward to assume the non-clamping position at least during a predetermined period when the card carrier table is moving forward after it has moved backward.

With such an arrangement, a print is impressed on the entire card surface, from its front to the rear, which is the same advantage as previously described.

In a preferred embodiment of the above printing method, when the printhead is spaced from the card surface and the clamping means assumes the non-clamping position, the pressing roller presses the card surface.

In this arrangement, it is possible to cause either of the clamping means and the pressing roller to retain the card at any moment when the card carrier table is moved to impress a print on the entire surface of the card on the card carrier table. Due to this arrangement and the thick cards to be used, the positional deviation of each card relative to -the card carrier table is reliably prevented. Thus, for performing color printing in particular, a high printing quality on the card surface is maintained.

According to a sixth aspect of the present invention, there is provided a method of printing on cards using the card printer according to the fourth aspect of the present invention. In the method, thick cards or sheets are used, and the card carrier table retaining each card on the upper surface of the table is reciprocated forwardly and rearwardly. The method includes the steps of: impressing a print on said each card from the leading edge toward a trailing edge of said each card with the printhead held in contact with said each card via the ink ribbon when the card carrier table is moved forward; keeping the printhead away from said each card when the card carrier table is moved backward; and repeating the above two steps a plurality of times for successively impressing a print in Y(yellow), M(magenta) and C(cyanine), and, if necessary, B(black). The clamping means assumes the clamping position at least during a period when the card carrier table is moving forward to impress a print on the card or sheet by the printhead.

With such an arrangement, even in a case where printing is performed on a thin card or sheet, the leading edge of the card or sheet is always clamped, thereby pulling the card or sheet forwardly during a printing operation performed for its surface. Thus, it is possible to prevent the positional deviation of the card or sheet and advantageously impress a print on a substantially entire surface of the card except the leading edge.

A preferred embodiment of the above printing method further includes the step of applying a coating material prepared in a predetermined region of the ink ribbon to the card or sheet by the printhead before printing operations where Y(yellow), M(magenta) and C(cyanine), and if necessary B(black) are performed.

With such an arrangement, color printing using a sublimation type ink ribbon is properly performed regardless of the material of the card or sheet.

Further, in the preferred embodiment of the above printing method, the printhead is lifted up by a predetermined distance for detaching the ink ribbon from the card or sheet after the card carrier table is moved forward for impressing a print on the card or sheet by the printhead.

With such an arrangement, it is possible to reliably prevent improper feeding of the ink ribbon caused by possible adhesion of the ink ribbon to the card or sheet, and erroneous card transfer resulting from the improper feeding of the ink ribbon. As a result, proper printing operations can be achieved.

According to a seventh aspect of the present invention, there is provided a method of printing on a card comprising; reciprocating a card carrier table forwardly and backwardly, the card carrier table having a surface for supporting the card; and impressing a print on the card by a printhead when the card carrier table is moved in a direction, the printhead contacting the card via an ink ribbon; wherein a rear portion of the card is pressed onto the card carrier table when the printhead corresponds to a forward region of the card in location, whereas a front portion of the card is pressed onto the card carrier table when the printhead corresponds to a backward region of the card in location.

With such an arrangement, either of a forward portion or a rearward portion of the card is retained on the card carrier table at any moment when the card carrier table is moved to impress a print on the entire surface of the card on the card carrier table. Thus, it is possible to prevent the positional deviation of the card relative to the card carrier table. As a result, for performing color printing in particular, a high printing quality on the card surface is maintained.

Other features and advantages of the present invention will become clear from the following detailed description given with reference to the accompanying drawings.

BEST MODE FOR CARRYING OUT THE INVENTION

Preferred embodiments of the present invention will be specifically described below with reference to the drawings.

Figure 1:
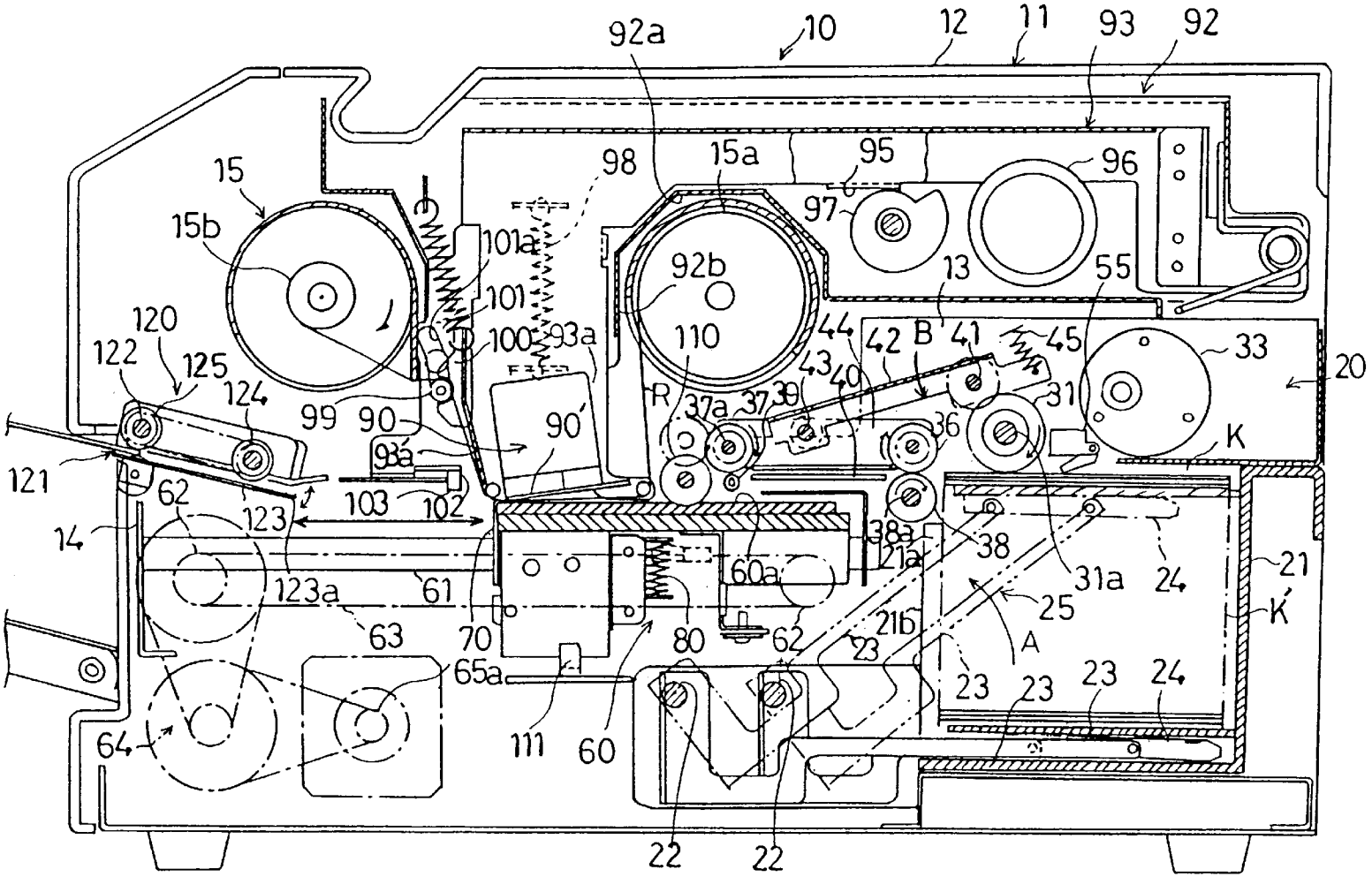
FIG. 1 is a sectional view showing an overall arrangement of a card printer according to an embodiment of the present invention.

FIG. 1 is a schematic vertical sectional view illustrating the overall configuration of a card printer 10 as an embodiment of the present invention. With the card printer 10, a plurality of cards K are held as a stack within a card stocker 21. Each of the cards is successively fed forward (in the lefthand direction in FIG. 1) to be placed onto a card carrier table 60. The card carrier table 60 supporting thus placed card K is caused to reciprocate forwardly and rearwardly a plurality of times. During this movement, a printhead 90 impresses a print in Y, M and C, and if necessary B, in an overlapping manner. Then, the printed card is picked up and further fed forward to be discharged. In this specification, the mechanism for feeding forwardly each of the cards K one after another from the card stocker 21 and supplying the card onto the card carrier table is referred to as a card supply mechanism 20. The card carrier table 60 is a mechanism having an upper surface to support thus supplied card K and reciprocating forwardly and rearwardly. The mechanism for picking up a printed card from the card carrier table 60 and feeding the card still forwardly for discharge is referred to as a card discharge mechanism 120.

As shown in FIG. 1, the card supply mechanism 20 is arranged at a rear (righthand in FIG. 1) portion in a printer housing 11. The card carrier table 60 to receive the cards from the card supply mechanism 20 reciprocates between a middle portion and a forward (lefthand in FIG. 1) portion in the printer housing. The card discharge mechanism 120 is arranged at a front portion in the printer housing 11.

The printhead 90 is attached to an open-close lid 12. The printhead is arranged above the card carrier table 60 and held in facing relation to the same table. A ribbon cartridge 15 is releasably supported by a predetermined portion of the printer housing 11. The ink ribbon R of the ribbon cartridge, which is unwound from a supply roll 15*a,* passes under the printhead 90 and is rewounded around a winding roll 15*b.*

The card stocker 21, which is an upwardly open box-like member, is provided at a rear portion of the printer housing 11. The card stocker is inserted in a sliding manner via an opening formed in a rear surface of the printer housing 11. The card stocker 21 accommodates a plurality of cards K in a stack. The card stack K' is constantly urged upward by an elastic force applied to the bottom of the stack. According to the preferred embodiment, the card stocker 21 has a front wall 21*a* formed with slits 21*b*. Front and rear link arms 23, 23 extend via the slits into the card stocker 21. The link arms are pivotable about shafts 22, 22. A press plate 24 is pinned to ends of the link arms 23, 23, forming a parallelogram linkage mechanism 25. The linkage mechanism is always biased in the direction indicated by an arrow A in FIG. 1. In this way, the above-mentioned upward urge to the card stack K' is achieved. With the parallelogram linkage mechanism 25, the press plate 24 is located at a bottom position as indicated by solid lines in FIG. 1 when the card stocker 21 is completely filled with the cards K. On the other hand, as the thickness of the card stack K' decreases due to the supply of the cards K, the press plate 24 is progressively raised as indicated by phantom lines in FIG. 1. In this way, it is possible to elastically urge the card stack K' upward with a predetermined force, regardless of the number of the remaining cards.

Figure 2:
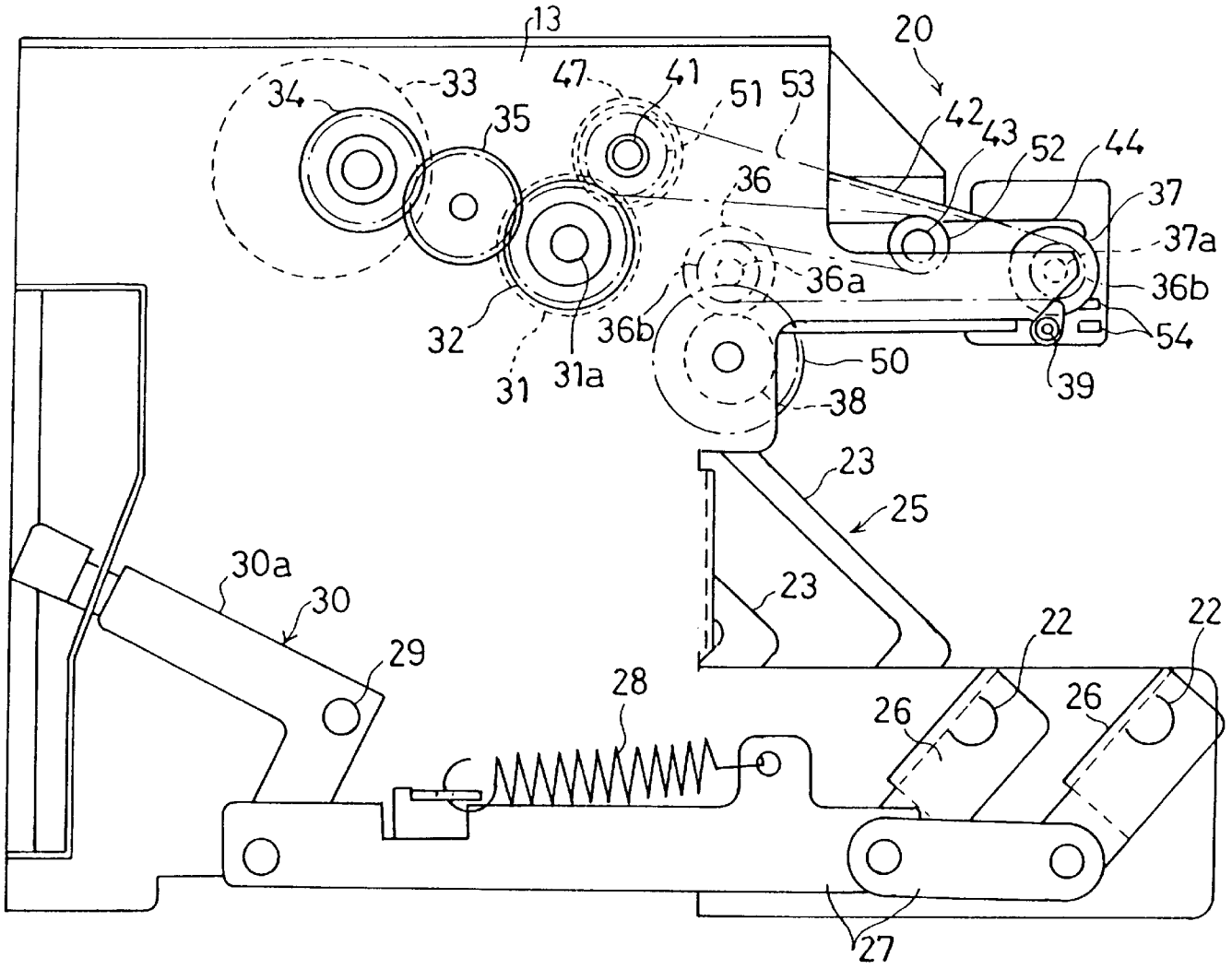
FIG. 2 is a view as seen in the direction indicated by an arrow II in FIG. 3.

As shown in FIG. 2, the shafts 22, 22 are connected to respective operation arms 26, 26 which in turn are connected to links 27 extending in a front-rear direction. The elastic bias to the parallelogram linkage mechanism 25 is achieved by urging the links 27 rearwardly with the action of a spring 28. The rear end of the links 27 is pinned to an end of a bell crank 30 pivotable about a shaft 29. When the lever 30*a* of the bell crank is pressed down, the links 27 are caused to move forwardly against the elastic force of the spring 28. As a result, the parallelogram linkage mechanism 25 assumes a position indicated by the solid lines in FIG. 1, that is, a position where the press plate 24 is located at the bottom region. Owing to an unillustrated latch mechanism, it is possible to hold the parallelogram linkage mechanism 25 in the position where the press plate 24 is located at the bottom region, so that the card stocker 21 is inserted or removed. In this state, when the card stocker 21 is empty for example, the card stocker is taken out to be filled with cards and then inserted back. When the newly filled card stocker 21 is inserted back, an unillustrated latch release lever is moved by a suitable portion of the front wall of the card stocker 21, thereby releasing the holding mode of the parallelogram linkage mechanism 25 to cause the parallelogram linkage mechanism to be elastically urged.

An initial feed roller 31 is arranged to come into contact with a front portion of the upper surface of the uppermost card K of the card stack K'. The initial feed roller 31 is mounted on a feed roller shaft 31*a* for one-way rotation in a forward direction. The feed roller shaft is supported at its both ends by righthand and lefthand frame walls 13, 13, extending therebetween. In this specification, the forward direction is described as a direction for feeding cards K forwardly, and a reverse direction as the opposite. Being supported for one-way rotation in a forward direction means that only the rotational force in the forward direction of the feed roller shaft 31*a* is transmitted to the initial feed roller 31. More specifically, when the feed roller shaft 31*a* rotates in the forward direction (clockwise in FIG. 1), the rotational driving force is transmitted to the initial feed roller 31. On the other hand, when the feed roller shaft 31*a* rotates in the reverse direction (counter-clockwise in FIG. 1), the rotational force is not transmitted to the initial feed roller 31.

Figure 3:
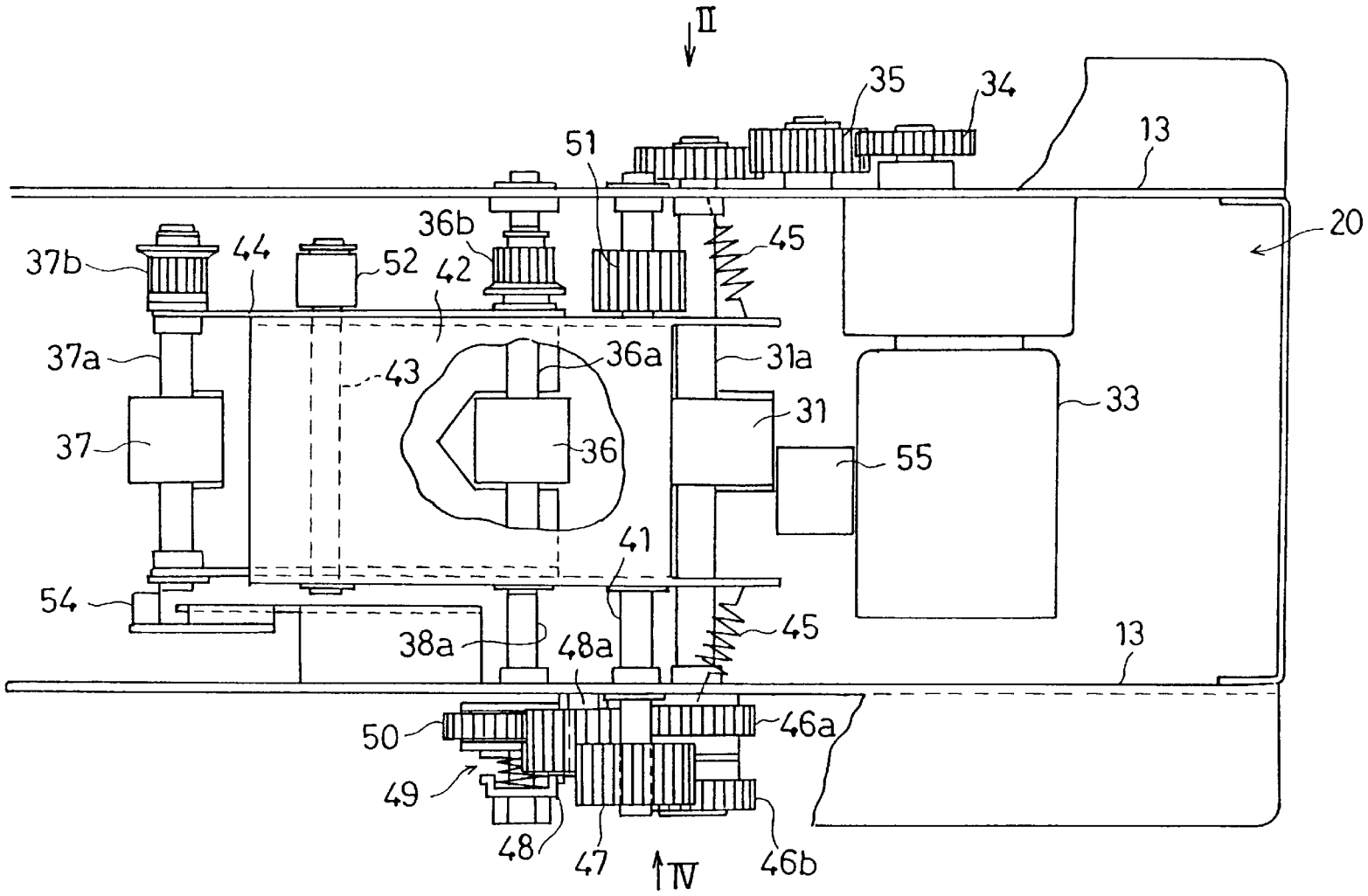
FIG. 3 is a plan view of a card supply mechanism.
Figure 5:
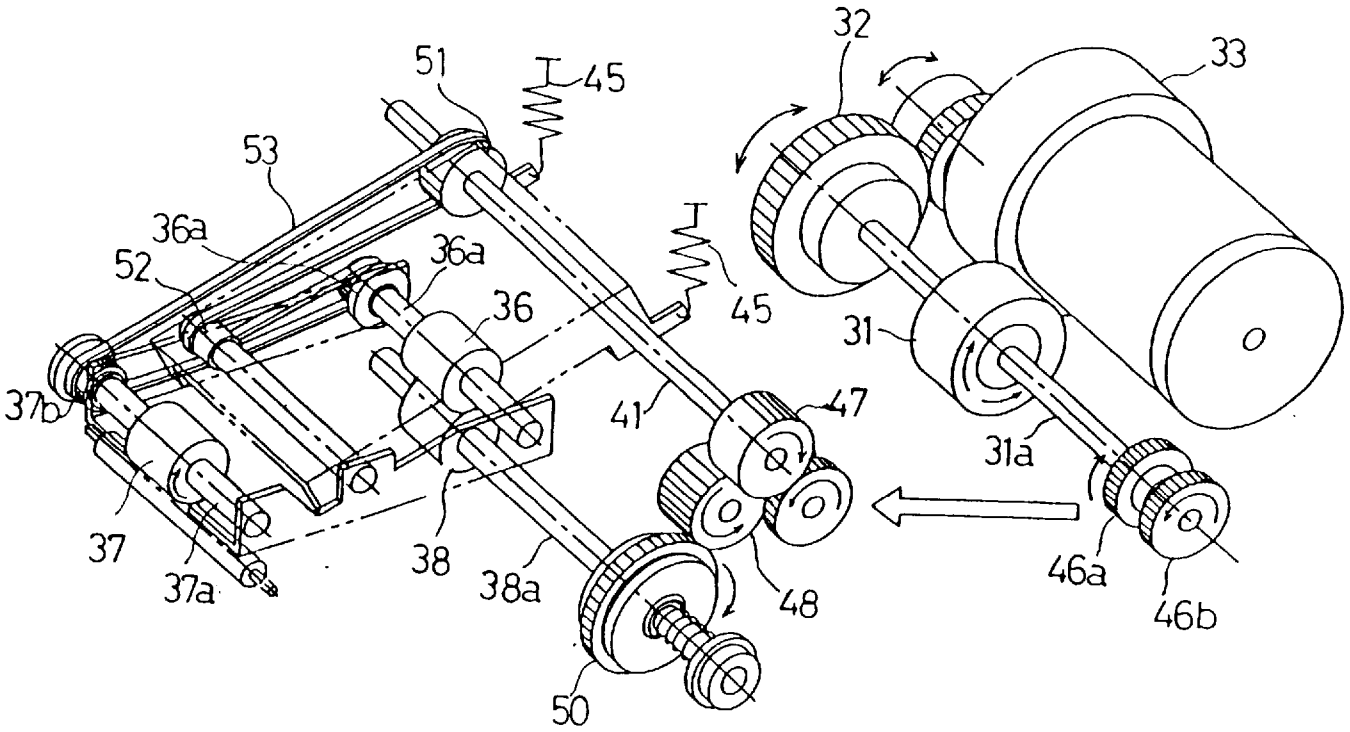
FIG. 5 is a perspective exploded view of principal parts of the card supply mechanism.

As shown in FIGS. 3 and 5, a gear 32 is provided at the right end of the feed roller shaft 31*a*, while a gear 34 is mounted on the output shaft of a DC motor 33. The gear 32 is associated with the gear 34 via an intermediate idle gear 35. The DC motor is rotatable in the forward and the reverse directions. Accordingly, the feed roller shaft 31*a* is caused to rotate in the forward and the reverse directions.

The initial feed roller 31 is rotated in the forward direction by the forward rotation of the feed roller shaft 31*a*. In this operation, the uppermost card K in the card stocker 21 is fed forwardly.

The card K fed forwardly by the initial feed roller 31 continues to be fed forward much further by a first intermediate feed roller 36 and a second intermediate feed roller 37 located ahead of the first intermediate feed roller. The first and second intermediate feed rollers 36, 37 are arranged to rotate while contacting the upper surface of the card K, thereby enabling the forward feeding of the card K. Further, the first and second intermediate feed rollers are vertically movable and constantly urged downward. A reverse roller 38 is arranged below and in facing relation to the first intermediate feed roller 36, while a backup roller 39 is arranged below and in facing relation to the second intermediate feed roller 37. A guide plate 40 is provided between the reverse roller 38 and the backup roller 39 for supporting the card K in a sliding manner.

The reverse roller 38 and the backup roller 39, which are mounted on respective shafts bridging between the righthand and lefthand frame walls 13, 13, are rotatable at a fixed position. On the other hand, as previously described, the first and second intermediate feed rollers 36, 37 are vertically movable and constantly elastically urged downward. In the present embodiment, such an arrangement is realized in the following manner.

As shown in FIGS. 1–4, a transmission shaft 41 is rotatably supported by the righthand and lefthand frame walls 13, 13, bridging therebetween. The transmission shaft 41 rotatably supports the base end of a first arm 42 extending forward. The first arm 42 has a front end to support an intermediate portion of the second arm 44 for pivotal movement via a shaft 43. The first intermediate feed roller 36 and the second intermediate feed roller 37 are supported by a front portion and a rear portion of the second arm 44, respectively, via transmission shafts 36*a*, 37*a*. The first arm 42 is urged by a spring 45 in the direction indicated by an arrow B, that is, in the direction causing the front end of the first arm 42 to shift downward.

With such an arrangement, the first intermediate feed roller 36 and the second intermediate feed roller 37 are always urged downward, that is, toward the respective reverse roller 38 and the backup roller 39 they face, while providing the so-called equalizer function.

As described below, the forward rotation of the first and second intermediate feed rollers 36, 37, and the reverse rotation of the reverse roller 38 are driven by the output of the DC motor 33 for rotating the initial feed roller 31.

As shown in FIGS. 1–5, the left end of the feed roller shaft 31*a* is provided with an inner forward one-way gear 46*a* and an outer reverse one-way gear 46*b*. The forward one-way gear 46*a*, to which only the forward rotational force of the feed roller shaft 31*a* is transmitted, is caused to rotate in the forward direction, whereas the reverse one-way gear 46*b*, to which only the reverse rotational force of the feed roller shaft 31*a* is transmitted, is caused to rotate in the reverse direction. The left end of the transmission shaft 41 rotatably supporting the first arm 42 as described above is provided with a transmission gear 47. The transmission gear 47 is held in mesh with the outer reverse one-way gear 46*b*. The frame wall 13 is provided with a fixed shaft 48*a* supporting an idle gear 48 which is held in mesh with both the transmission gear 47 and the inner forward one-way gear 46*a*. A reverse roller shaft 38*a* is rotatably supported by the righthand and lefthand frame walls 13, 13, bridging therebetween. The left end of this reverse roller shaft is provided with a reverse gear 50 driven for rotating relatively to the shaft via a friction clutch mechanism 49. The reverse gear 50 is held in mesh with the idle gear 48.

When the feed roller shaft 31*a* is driven for forward rotation, the forward one-way gear 46*a* rotates in the forward direction. This rotational movement is transmitted to the transmission gear 47 via the idle gear 48. In this case, due to the presence of the idle gear 48, the transmission gear 47 is rotated in the same direction as in the forward one-way gear 46*a*, that is, in the clockwise direction in FIGS. 1, 4 and 5. At this time, the reverse one-way gear 46*b* is rotated in the reverse direction, since it is also held in mesh with the transmission gear 47.

Figure 4:
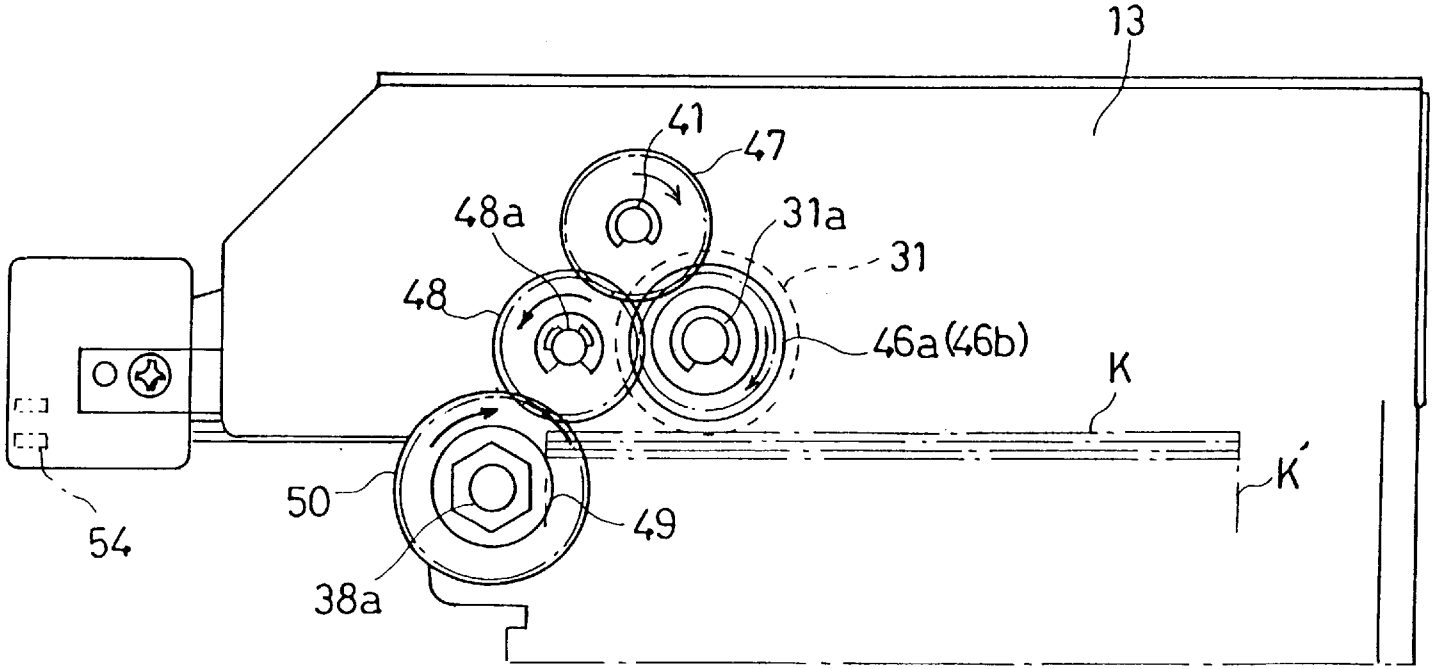
FIG. 4 is a view as seen in the direction indicated by an arrow IV in FIG. 3.

On the other hand, when the feed roller shaft 31*a* is rotated in the reverse direction, the outer reverse one-way gear 46*b* is rotated in the reverse direction, that is, in the counterclockwise direction in FIGS. 1, 4 and 5. This rotational force is transmitted to the transmission gear 47 directly held in mesh with the reverse one-way gear 46*b*. The reverse one-way gear 46*b* and the transmission gear 47 are rotated in the opposite direction to each other. Thus, in this case again, the transmission gear 47 rotates in the clockwise direction in FIGS. 1, 4 and 5, that is, in the direction for forwardly feeding the cards.

As described above, the transmission gear 47 and the transmission shaft 41 carrying the same gear are always rotated in the forward direction, whether the feed roller shaft 31*a* may be rotated in the forward direction or the reverse direction. However, since the initial feed roller 31 is mounted on the feed roller shaft 31*a* for forward one-way rotation, the initial feed roller 31 is not rotated in the reverse direction when the feed roller shaft 31*a* is rotated in the reverse direction and thus the initial feed roller 31 remains in a non-rotational state while held in pressing contact with the uppermost card K in the card stocker 21.

The rotational direction of the reverse gear 50 held in mesh with the idle gear 48 is clockwise in FIGS. 1, 4 and 5 as in the transmission gear 47. However, since the reverse roller shaft 38*a* supporting the reverse gear 50 is located below the card transfer path, the reverse gear 50 rotates in the reverse direction for card transfer. As previously described, the friction clutch mechanism 49 is arranged between the reverse gear 50 and the reverse roller shaft 38*a*, and therefore a reverse torque not greater than a predetermined value is transmitted to the reverse roller shaft 38*a*. The description of the significance of the reverse roller 38 will be given below together with the description of the overall function of the card supply mechanism 20.

The forward rotation of the transmission gear 47 and the transmission shaft 41 is transmitted to the first intermediate feed roller 36 and the second intermediate feed roller 37 via a belt-pulley transmission mechanism. As shown in FIG. 3, the right end of the transmission shaft 41 is provided with a toothed pulley 51. Similarly, the right ends of the transmission shaft 36*a* for the first intermediate feed roller 36 and the transmission shaft 37*a* of the second intermediate feed roller 37 are provided with toothed pulleys 36*b* and 37*b*, respectively. A belt roller 52 is rotatably supported by the right end of a shaft 43. This shaft supports the middle portion of the second arm 44 for pivotal movement with respect to the first arm 42.

The respective toothed pulleys 51, 36*b*, 37*b* and belt roller 52 are brought into contact with a toothed endless belt 53 in a manner shown in FIGS. 2 and 5. Specifically, the belt 53 is brought into engagement with the toothed pulley 51 mounted on the transmission shaft 41, and then the outer surface of the belt is brought into engagement with the belt roller 52. Then, the belt is brought into engagement with the toothed pulley 36*b* of the first intermediate feed roller shaft 36*a* and with the toothed pulley 37*b* of the second intermediate feed roller shaft 37*a*. Thereafter, the belt extends back to the toothed pulley 51 of the transmission shaft 41. As a result, the three toothed pulleys 51, 36*b*, 37*b* engaging the endless belt 53 and hence the shafts 41, 36*a*, 37*a* mounting the pulleys are rotated in the same direction or in the forward direction for card transfer. Further, the belt roller 52 is mounted on the shaft 43, around which the first arm 42 and the second arm 44 are pivotally supported. Therefore, the tension of the endless belt 53 hardly varies even when the second arm 44 pivots relative to the first arm 42.

In FIGS. 2 and 4, reference numeral 54 indicates a sensor for detecting the leading edge of the card K, whereas in FIGS. 1 and 3, reference numeral 55 indicates an empty sensor for detecting a state where no card is left in the card stocker 21.

The card supply mechanism functions as follows.

When a printing operation command is given, the initial feed roller shaft 31*a* is rotated in the forward direction. Accordingly, the initial feed roller 31 is rotated in the forward direction. The initial feed roller 31 contacts the upper surface of the uppermost card K in the card stocker by a predetermined elastic force. Thus, the uppermost card K is fed forward by the forward rotation of the initial feed roller 31. As previously described, the forward rotational driving force of the feed roller shaft 31*a* is transmitted to the first and second intermediate feed rollers 36, 37, thereby causing these intermediate rollers to rotate in the forward direction. Thus, when the card K is fed forward to a certain extent, the first intermediate feed roller 36 rides over the leading edge of the card K backed up by the reverse roller 38, and feeds the card K forward still further. Then, the second intermediate feed roller 37 rides over the leading edge of the card K supported below by the back up roller 39, and feeds the card K forward.

In the above instance, the card transfer is smoothly performed by the first and second intermediate feed rollers 36, 37 which are capable of providing the equalizer function, that is, pressing the card K with a uniform elastic force while feeding the card K. Further, the first and second intermediate feed rollers 36, 37 ride over the card K in a properly retreating manner according to the thickness of the card K and feed the card K with proper pressing force. As a result, the cards K are advantageously fed forward even when they vary in thickness.

When the leading edge of the card K is detected by the sensor 54, the card has left the initial feed roller 31, and the initial feed roller 31 is held in contact with the upper surface of the next card to be fed. At this time, the initial feed roller shaft 31*a* is rotated in the reverse direction. Then, as previously described, no forward driving force is transmitted to the initial feed roller 31 and this roller remains motionless held in elastic pressing contact with the uppermost card to be fed next. In this way, it is possible to advantageously prevent the next card to be fed from being dragged by the previously fed card. In this case again, as previously described, the first and second intermediate feed rollers 36, 37 continue to rotate in the forward direction. Thus, the card K is fed forward still further and will be placed onto the card carrier table 60 as described hereinafter.

As previously described, the reverse roller 38 facing the first intermediate feed roller 36 is rotated in the reverse direction with a torque of no greater than a predetermined value. When normal card transfer is being performed, the rotating torque of the first intermediate feed roller 36 is greater than that of the reverse roller. Therefore, the first intermediate feed roller 36 feeds the card K forwardly against the reverse rotating torque of the reverse roller 38.

On the other hand, when two cards K are stacked and erroneously put between the first intermediate feed roller 36 and the reverse roller 38, the next card stacked under the card currently intended to be transferred is drawn rearward by reverse driving force of the reverse roller 38 to be brought back to the uppermost position of the card stocker 21. At this time, when the feed roller shaft 31*a* is rotated in the reverse direction, the initial feed roller 31 is free to rotate in the reverse direction as far as its rotational speed is not greater than that of the feed roller shaft 31*a* rotating in the reverse direction. Thus, it is possible to prevent hindrance of the rearward drawing movement of the next card by the reverse rotation of the reverse roller 38.

The card fed forward by the card supply mechanism 20 in the above manner will be placed in a predetermined position on the card carrier table 60 described below.

Figure 6:
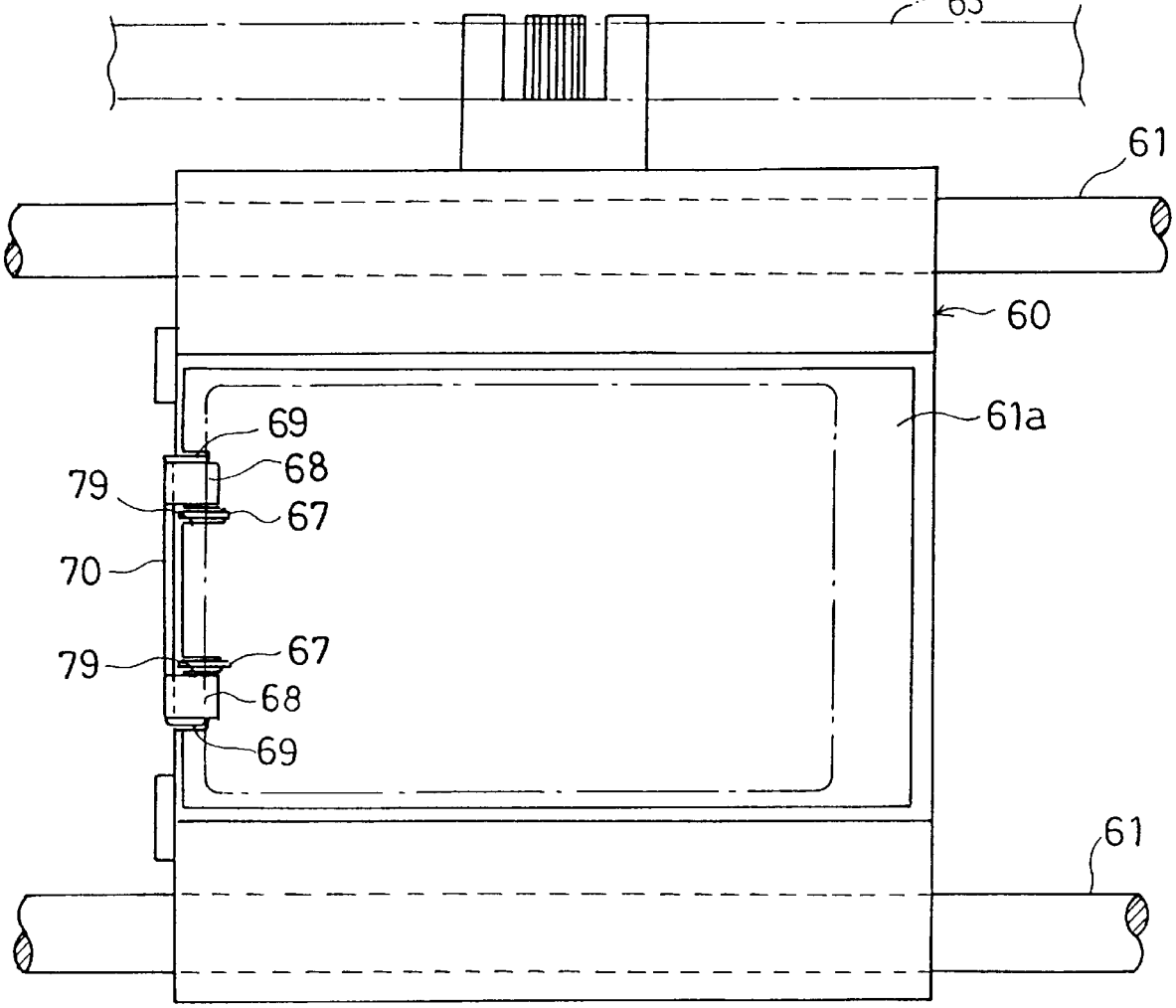
FIG. 6 is a plan view of a card carrier table.

As shown in FIG. 6, the card carrier table 60 has a planar surface area large enough to receive the card K. Further, the carrier table is supported by a pair of right and left guide rods 61, 61 for forward and rearward movement in a sliding manner. The guide rods extend in the front-rear direction and are attached at their both ends to proper portions of a chassis frame 14. A side portion of the card carrier table 60 is connected to a suitable portion of an endless belt 63 engaging belt pulleys 61, 61 which are mutually spaced in the front-rear direction (FIG. 1). It is possible to reciprocate the card carrier table 60 forwardly and rearwardly along the guide rods 61, 61 by moving the endless belt 63 in a forward and a rearward directions. One of the belt pulleys 62, 62 is connected via a suitable belt-pulley speed-reduction mechanism to an output shaft 65*s* of a step motor or an electric motor associated with a rotary encoder. Thus, the forward and rearward movement of the card carrier table 60 is controlled as required by controlling the rotation of the motor 65.

The upper surface of the card carrier table 60 is provided with a table surface 60*a* constructed by a synthetic resin plate for example. Thus, a plastic card having a smooth bottom surface for example is supported with a certain adhesive force to prevent deviation.

In the present embodiment, the card carrier table 60 includes clamping means 65 for positioning the card K fed from the card supply mechanism 20 and clamping the leading edge of the card, and card lifting means 66 retractably projectable at a front end of the table surface for lifting the leading edge of a printed card K for discharge of the card.

The clamping means 65 selectively assumes a clamping state where the leading edge of the card K is fixedly clamped against the table surface 60*a*, a positioning state where the leading edge of the card fed onto the table surface 60*a* is directly contacted for positioning the card, and a non-clamping state where the clamping means is brought forward away from the front end of the table surface 60*a*. The card lifting means 66 selectively assumes a card lifting state where a projection pin 67 adjacent to the clamping means 65 projects upward to a predetermined extent from the table surface 60*a*, and a state where the projection pin 67 is retracted downwardly from the table surface 60*a*.

Figure 8:
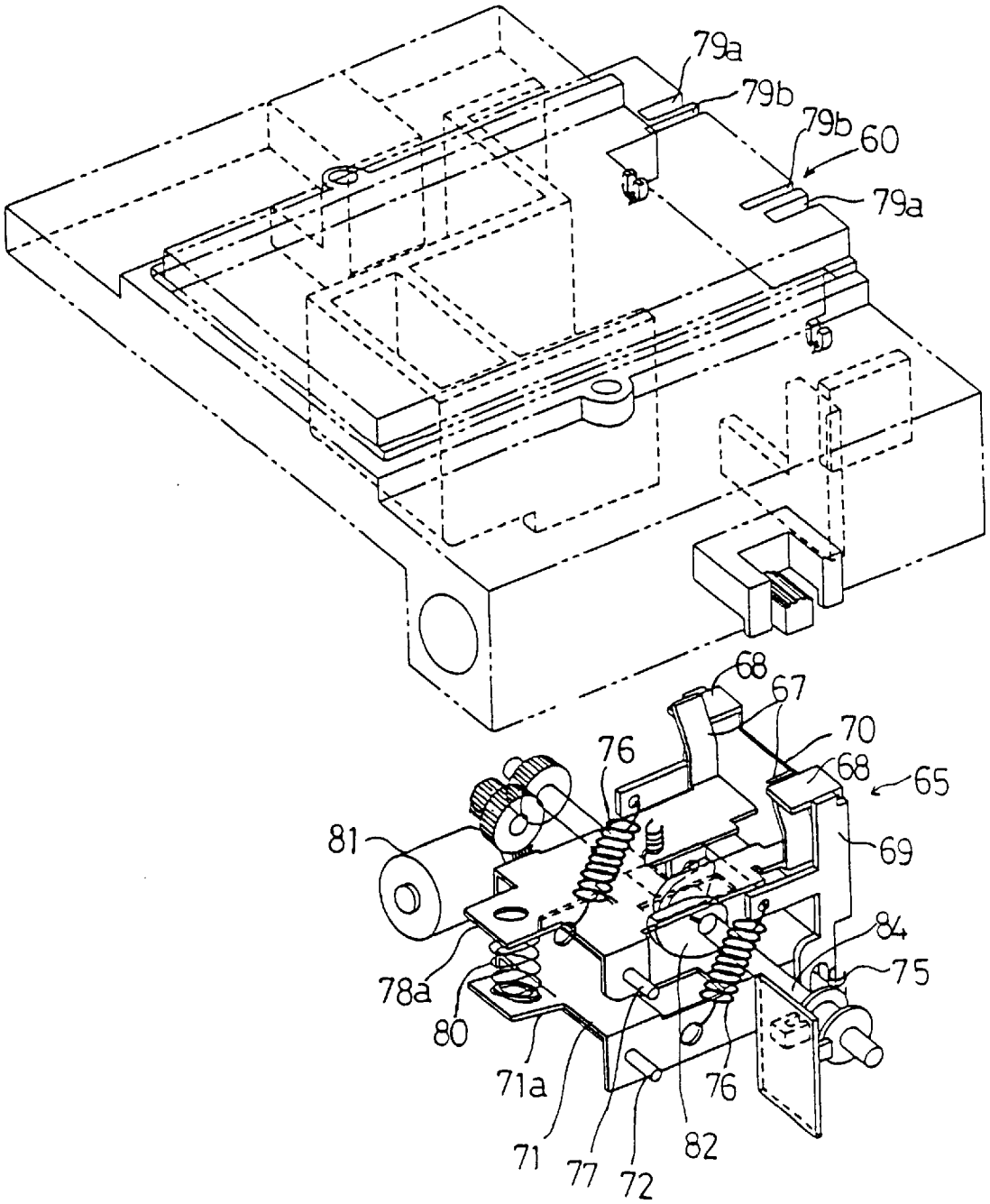
FIG. 8 is a perspective exploded view of principal arrangements of the card carrier table, in which the card carrier table is viewed from a righthand, above and rearward position.

As shown in FIGS. 6 and 8, the clamping means 65 includes a generally vertical clamp plate 70 which has, at upper portions thereof, a pair of right and left clamp claws 68, 68 extending from ahead of the table surface 60*a* and over the front end of the table, and a pair of right and left positioning pieces 69, 69 for determining the position of the card K with respect to the front-rear direction by directly contacting the leading edge of the card. Below the card carrier table 60, a base end of a generally horizontal link plate 71 is connected via a pin 72 to a bracket 73 for pivotal movement, whereas a front end of the link plate 71 is connected via a pin 74 to a lower end of the clamp plate 70 for pivotal movement. The pin 74 belongs to the link plate 71 and engages a vertically extending elongated bore 74*a* formed in a lower portion of the clamp plate 70. Thus, the clamp plate 70 is capable of pivoting about the pin 74 with respect to the link plate 71, and vertically movable with respect to the link plate 71 or the pin 74 as far as the elongated bore 74*a* permits.

Figure 9:
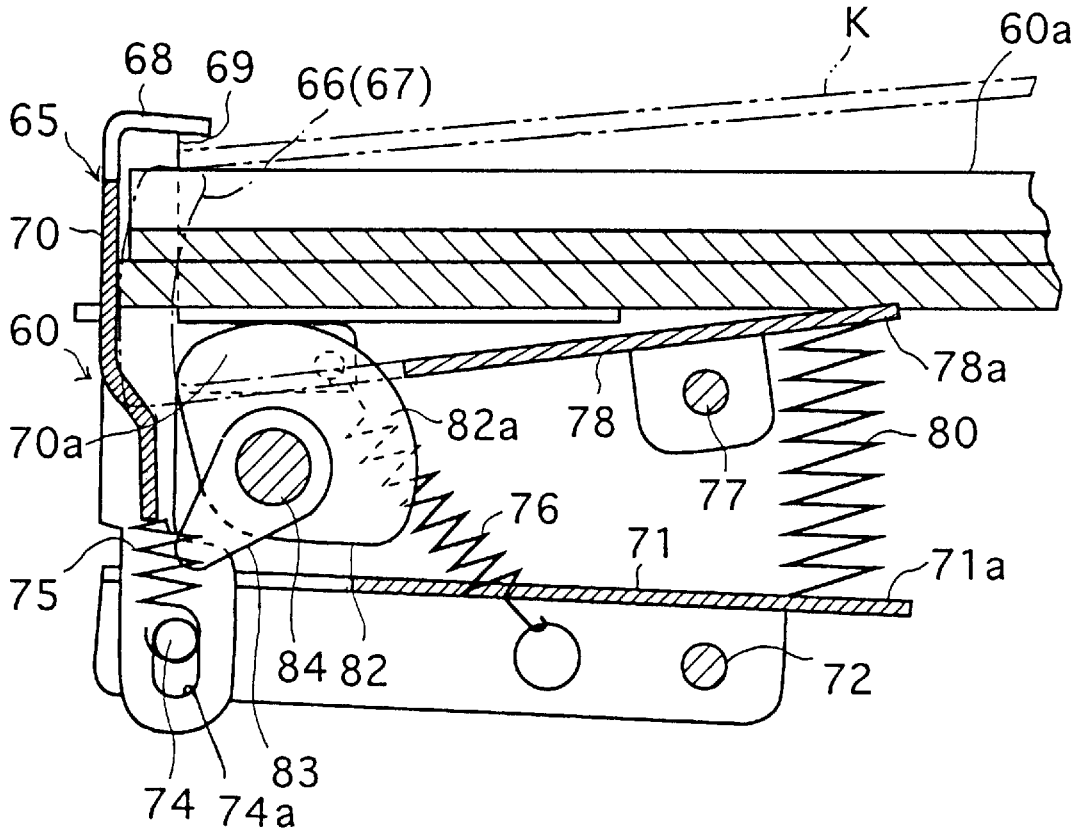
FIG. 9 illustrates the function of the card carrier table and represents a first state in which a clamp claw and a positioning piece project from the table surface, whereas a card lifting pin is pulled down below the table surface.

The link plate 71 is always urged upward (clockwise about a pin 72) by an extension spring 75 arranged between the pin 74 and the bracket 73. The clamp plate 70 is formed with an arm 70*a* projecting rearwardly from the rear surface of the plate. Between the arm and the link plate 71, an extension spring 76 is diagonally arranged, respective ends of which are fixed to the arm 70*a* and the link plate 71. The spring 76 constantly urges the clamp plate 70 rearwardly (clockwise about the pin 74) and also downwardly with respect to the link plate 71. The arm 70*a* projecting rearward comes into direct contact with the bottom surface of the card carrier table 60, thereby preventing the clamp plate 70 from moving upward beyond a predetermined extent. In other words, the arm also works as a stopper for preventing the clamp claws 68, 68 from projecting from the table surface 60*a* beyond a predetermined extent. Further, as previously described, the spring 76 constantly urges the clamp plate 70 downward with respect to the link plate 71. As a result, as shown in FIG. 9, the upper end of the elongated bore 74*a* engaging the pin 74 is held in direct contact with the pin 74 in a normal state.

The projection pins 67, 67 project upward from a front end of a pin support table 78 extending generally horizontally. The pin support table has a base end pivotally connected via a pin 77 to the bracket 73 immediately below the bottom surface of the card carrier table 60. The card carrier table 60 and the table surface 60*a* are formed with slits 79*a*, 79*a* through which the clamp claws 68, 68 and the positioning pieces 69, 69 are retractably projectable, and adjacent slits 79*b*, 79*b* through which the projection pins 67, 67 are retractably projectable. The pin support plate 78 has an extension 78*a* extending rearward beyond the pin 77 supporting the plate 78, while the link plate 71 has a rearwardly extending extension 71*a*. A compression spring 80 is arranged between the above extensions, so that the pin support plate is urged in a direction causing the projection pins 67, 67 to retract from the table surface 60*a* (counterclockwise about the pin 77).

The operation of the clamping means 65 and the card lifting means 66 is realized by cams 82, 83 which are rotationally driven by a motor 81 provided on the bottom surface of the card carrier table 60.

Figure 7:
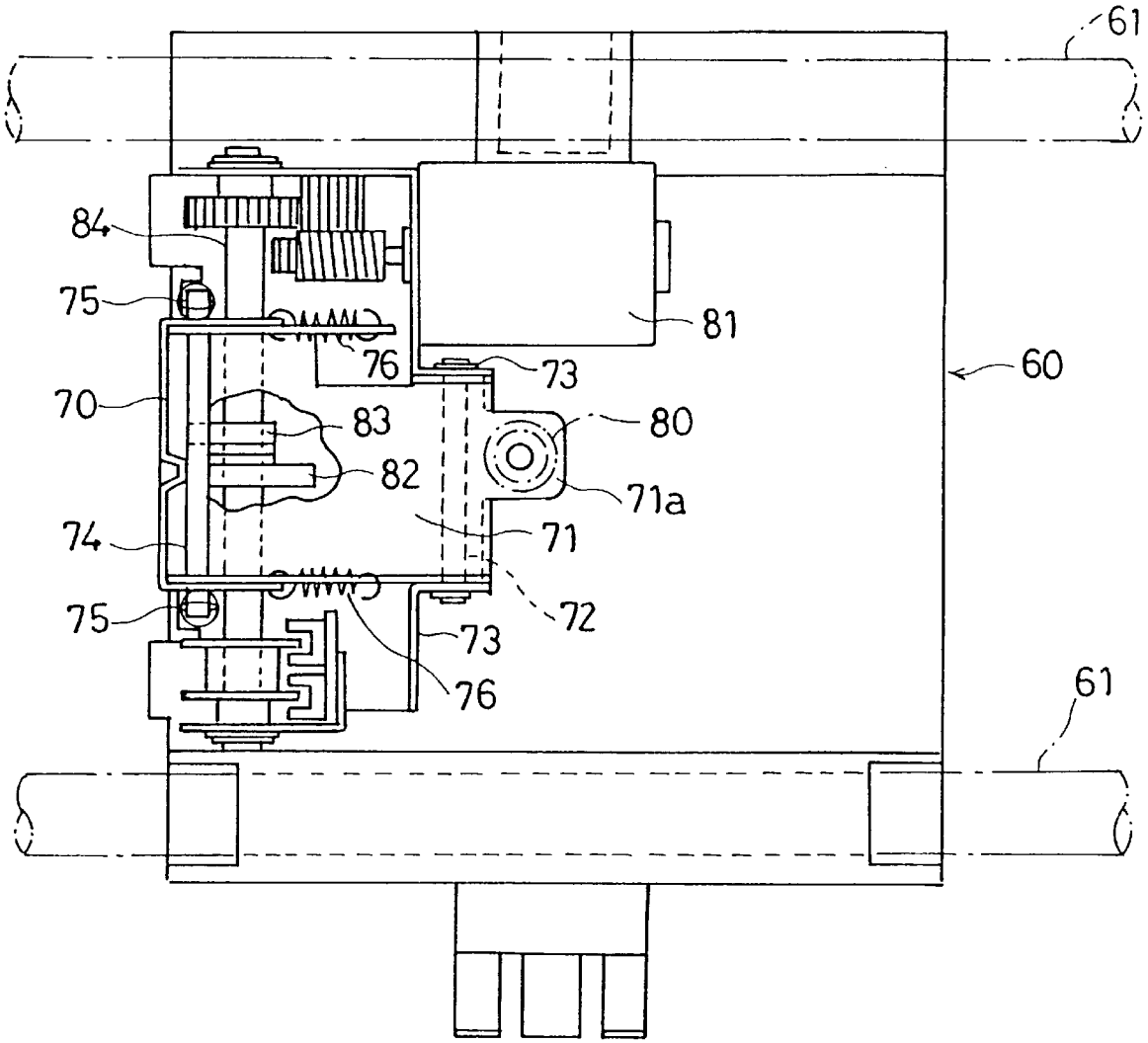
FIG. 7 is a bottom view of the card carrier table.

The cams 82, 83 are coaxially mounted on a cam shaft 84 supported by the bracket 73. The cams are driven for forward and reverse rotations by the motor 81 provided on the bottom surface of the card carrier table 60 (see FIGS. 7 and 8). As shown in FIG. 9, the cam 82 to operate the clamping means 65 has a generally fan-shaped configuration including an arcuate cam surface 82*a* having a predetermined central angle. When the cam 82 is suitably rotated, the arcuate cam surface 82*a* presses the bottom surface of the clamp plate 70 and/or the upper surface of the link plate 71, thereby causing the clamp claws 68, 68 to assume predetermined positions.

As shown in FIG. 9, when the cam 82 contacts neither the clamp plate 70 nor the link plate 71, the link plate 71 tends to move upward due to the spring 75, and the clamp plate 70 tends to rotate rearward due to the spring 76. As a result, the clamp plate 70 tends to move upward and also to rotate rearward. However, an upward movement beyond a predetermined extent is prevented by the arm 70*a* contacting the bottom surface of the table 60. Similarly, a rearward rotation is restricted by the clamp plate 70 itself contacting the front edge of the table 60. In this way, the clamp claws 68, 68 and the adjacent positioning pieces 69, 69 are caused to project from the table surface 60*a* to a predetermined extent. This is described as a positioning state for performing the positioning of the card k by causing the positioning pieces 69, 69 to directly contact the leading edge of the card fed onto the table surface 60*a*.

Then, as the cam 82 is rotated clockwise starting from the above state, the arcuate cam surface 82*a* presses down the link plate 71. At this time, the cam 82 does not act on the clamp plate 70. As a result, the clamp plate 70 having the clamp claws 68 at the upper end thereof is pulled downward by a predetermined distance, while held in contact with the front end of the table 60. In this case, it should be noted that the clamp plate 70 is not pulled downward by the pin 74.

Figure 10:
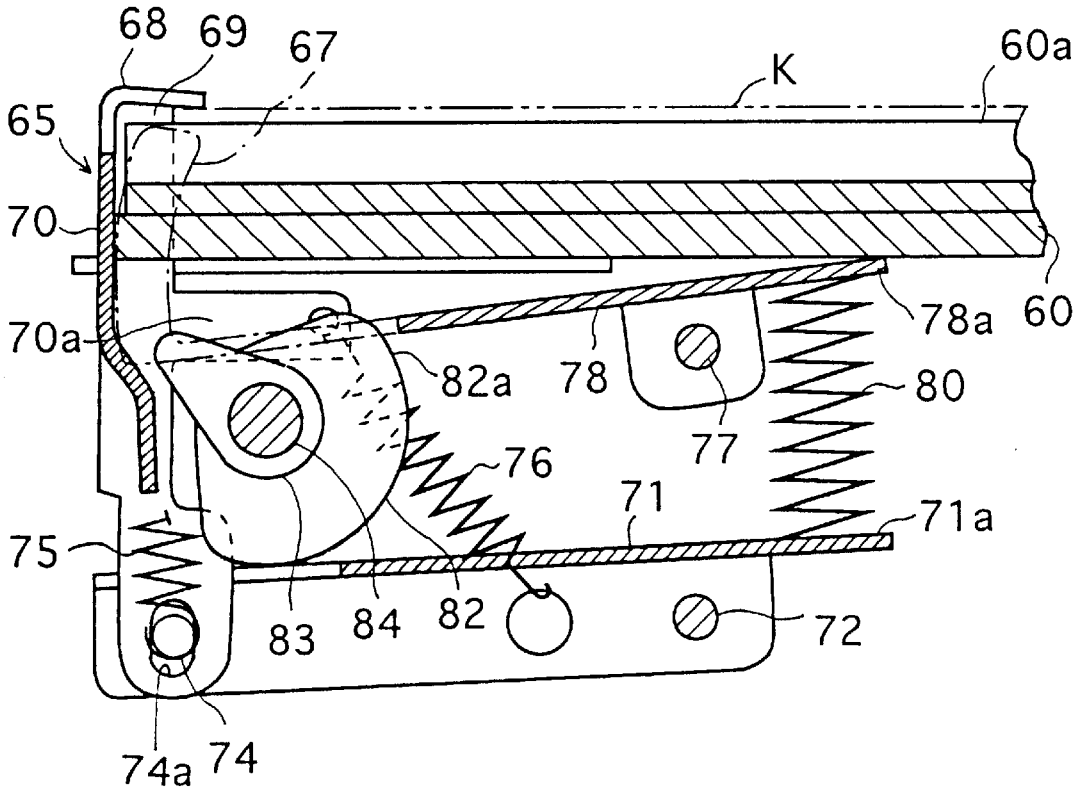
FIG. 10 illustrates the function of the card carrier table and represents a second state in which the clamp claw is lowered compared to the first state to clamp the leading edge of a card against the table surface, and the card lifting pin is pulled down below the table surface.

Instead, as previously described, the clamp plate moves downward following the downward movement of the link plate 71, with the pin 74 held in contact with the upper end of the elongated bore 74*a* of the clamp plate 70 due to the action of the spring 76. In the positioning state, when the leading edge of the card K is placed between the clamp claws 68, 68 and the table surface 60*a*, the card K comes to be clamped and held between the clamp claws 68, 68 and the table surface 60*a*. This clamping force is obtained substantially by the elastic force of the spring 76. After the clamp claws 68, 68 are brought down to the clamping state for the card K, it is impossible to additionally lower the clamp claws 68, 68 and the clamp plate 70. In such a case however, as shown in FIG. 10, the pin 74 is spaced from the upper end of the elongated bore 74*a* of the clamp plate 70 by a distance corresponding to the thickness of the card K. In other words, owing to the elastic force of the spring 76, the clamp claws 68, 68 clamp the card K against the table surface 60*a* with a predetermined holding force, regardless of the thickness of the card K.

Conversely, as the cam 82 is rotated counterclockwise as viewed in FIG. 10 from the clamping state, the pressing contact of the cam 82 with the link plate 71 is released, and the clamp claws 68, 68 are caused to project from the table surface 60*a* and brought back to the positioning state. As the cam 82 is further rotated counterclockwise as viewed in FIG. 9, the arcuate cam surface 82*a* is brought into pressing contact with the bottom surface of the clamp plate 70 to shift the clamp claws 68, 68 forwardly. In other words, the clamp plate 70 is tilted forward about the pin 74 with respect to the link plate 71. Further, due to the balancing of the two springs 75, 76, the link plate 71 also rotates slightly downward about the pin 72. As the result of such operations, the clamp claws 68, 68 moves not only forward but slightly downward (FIG. 1).

Figure 11:
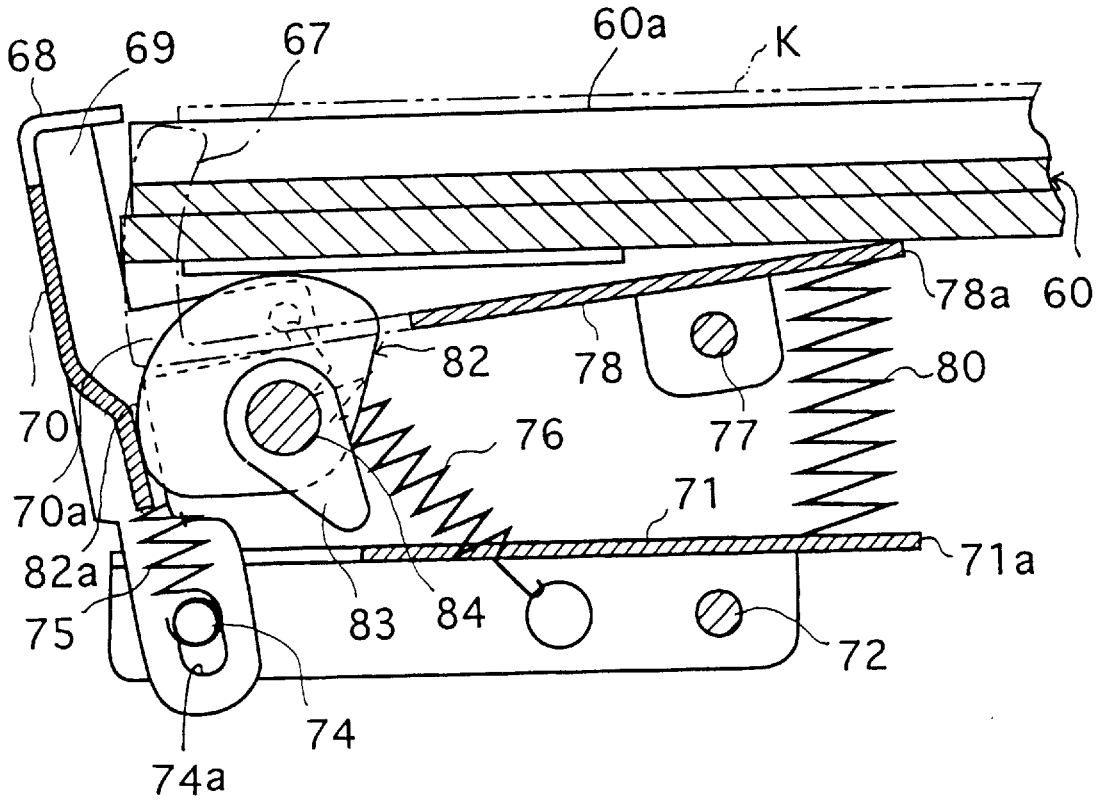
FIG. 11 illustrates the function of the card carrier table and represents a state in which the clamp claw is moved forward away from the front edge of the table surface compared to the first state. At this stage, the card lifting pin is still pulled down below the table surface.
Figure 12:
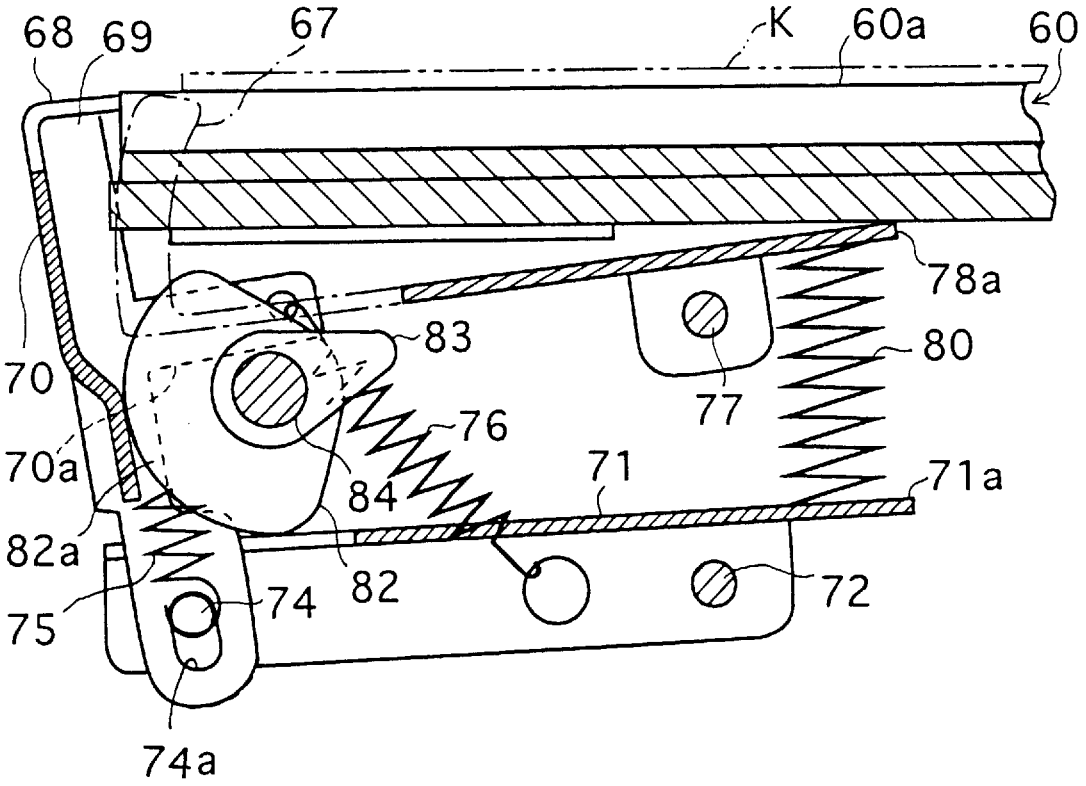
FIG. 12 illustrates the function of the card carrier table and represents a third state in which the clamp claw is moved forward and also pulled down below the card surface compared to the state shown in FIG. 11. At this stage again, the card lifting pin is still pulled down below the table surface.

As the cam 82 is further rotated counterclockwise in FIG. 11 from the above state, the arcuate cam surface 82*a* is brought into contact with the upper surface of the link plate 71 to press down the link plate by a predetermined distance, while held in contact with the bottom surface of the clamp plate 70, as shown in FIG. 12. Then, the clamp claws 68, 68, which are moved forward as shown in FIG. 11, are pulled down below the upper surface of the table surface 60*a* (FIG. 12). This state is described as a non-clamping position where the clamp claws 68, 68 are spaced away from the front edge of the table surface 60*a*.

Figure 13:
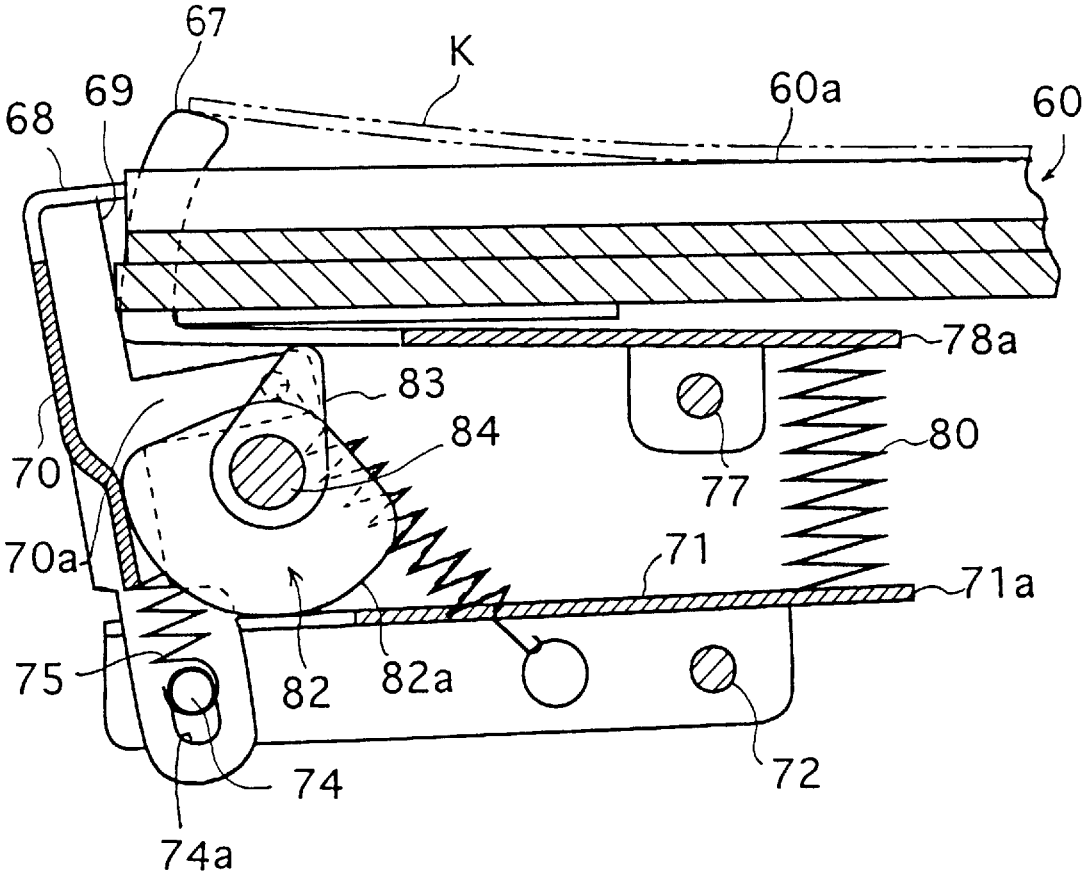
FIG. 13 illustrates the function of the card carrier table and represents a fourth state in which the clamp claw is moved forward and pulled down below the card surface as in FIG. 12, whereas the card lifting pin projects from the table surface.

Further, the pin support plate 78 supporting the projection pins 67, 67 is normally pulled down below the table surface 60*a* due to the elastic force of the compression spring 80 as indicated by phantom lines in FIGS. 9–12. The cam 83 for operating the pin support plate 78 has an arm-shaped configuration radially extending from the cam shaft 84. Therefore, in rotating the cam 83, the cam 83 at a predetermined rotational position raises the pin support plate 78, thereby projecting the projection pins 67, 67 from the table surface 60*a* as shown in FIG. 13.

As previously described, the projection pins 67, 67 are for lifting up the leading edge of the printed card K from the table surface 60*a*. Thus, in this state, it is necessary for the clamping means 65 to assume the non-clamping position. Taking these things into consideration, the relative rotational positions of the two coaxitially fixed cams 82, 83 are determined. More specifically, the projection pins 67 should be raised from the table surface 60*a* when the clamp claws 68, 68 are moved forwardly and located below the table surface 60*a* as shown in FIG. 13.

As clearly seen from the above description, it is possible to cause the clamp claws 68, 68 and the projection pins 67, 67 to selectively assume the following states by controlling the rotation of the motor 81 provided below the bottom surface of the card carrier table 60: ① positioning state (a first state shown in FIG. 9) where the projection pins 67, 67 are located below the table surface 60*a*, and the clamp claws 68, 68 and the adjacent positioning pieces 69, 69 are caused to project from the table surface 60*a*; ② clamping state (a second state shown in FIG. 10) where the projection pins 67, 67 are located below the table surface 60*a*, while the clamp claws 68, 68 are lowered to clamp the leading edge of the card K against the table surface 60*a*; ③ non-clamping state (a third state shown in FIG. 12) where the clamp claws 68, 68 are moved forward and located below the table surface 60*a*; and ④ lifting state for the leading edge of the card (a fourth state shown in FIG. 13) where the clamp claws 68, 68 are moved forward and located below as in the above state, and the projection pins 67 are caused to project upward from the table surface 60*a*.

Specific operations of the card carrier table with the above arrangements will be described hereinafter in relation to a printhead 90 described below.

As already touched upon with reference to FIG. 1, the printhead 90 is supported by the open-close lid 12, so that the printhead is arranged above and in facing relation to the card carrier table 60. More specifically, the open-close lid 12 is attached to the upper surface of a printhead housing 92 which in turn is attached to the chassis frame 14 for opening and closing rotation about a shaft 91. The printhead housing 92 as a whole is made in a form of an upwardly open channel extending forward. The intermediate bottom surface of the printhead housing 92 is formed with a recess 92*a* for accommodating the supply roll 15*a* of a ribbon cartridge 15. A downwardly open polygon member 92*b* is formed ahead of the recess 92*a*.

A printhead support arm 93 extending in a front-rear direction is accommodated in the housing 92. The support arm is capable of pivoting in an up-down direction about the shaft 91 in the housing 92. The printhead support arm 93 has a front portion formed with a generally box-shaped printhead support member 93*a* extending downward. The printhead support member 93*a* comes to be held in facing relation to the polygon member 92*b*. A thermal printhead 90' is attached to the lower end of the printhead support member 93*a*. The thermal printhead 90' is a line type, which has an array of heating dots extending laterally of the printer and is suitable for using a sublimation type color ink ribbon. In the illustrated embodiment, the thermal printhead 90' is arranged in a tilting manner with its trailing edge located higher than its leading edge along which the heating dots are formed. A printing operation is performed while the printhead is moved backward relative to the card K on the card carrier table.

The printhead support arm 93 is provided at its intermediate portion with a flat cam follower 95 facing downward. In the housing 92, a rotation cam 97 is provided that is rotated by a motor 96 via some gears. A spring 98 urges the printhead support arm 93 downward relative to the printhead housing 92. Thus, the cam follower 95 is constantly held in contact with the outer cam surface of the rotation cam 97 from above.

The cam profile of the rotation cam 97 is adjusted so that the radius to the contacting point at which the cam follower 95 is contacted is variable as the rotation cam is rotated. Thus, it is possible to vertically pivot the printhead support arm 93 about the shaft 91 by selecting the rotational positions of the rotation cam 97. Accordingly, it is also possible to select the heights of the printhead 90' relative to the card carrier table 60. For instance, the printhead 90' can selectively assume a position where the printhead comes into contact, under a predetermined pressing force, with the card K held on the card carrier table 60, and a position where the printhead 90' is spaced from the card by a predetermined distance. The elastic force for pressing the printhead 90' onto the card K should be obtained by the spring 98 to bias the printhead support arm 93 downward. With such an arrangement, the printhead 90' is brought into contact with the card by a proper pressing force even when the cards used are varied in thickness.

In the above arrangement, it is preferable that the torsional rigidity of the printhead support arm 93 is set to be no greater than a predetermined value so that the printhead 90' is movable in an operational direction. In this arrangement, even when the lateral orientation of the table surface 60*a* of the card carrier table 60 deviates from a horizontal line, or the cards K differ in material or thickness, the printhead 90' can be brought into contact with the entire lateral length of each card K under a uniform pressing force when the printhead 90' is elastically urged onto the card K held by the card carrier table 60. As a result, deterioration of printing quality, which otherwise might occur due to uneven pressing force, is prevented.

Figure 14:
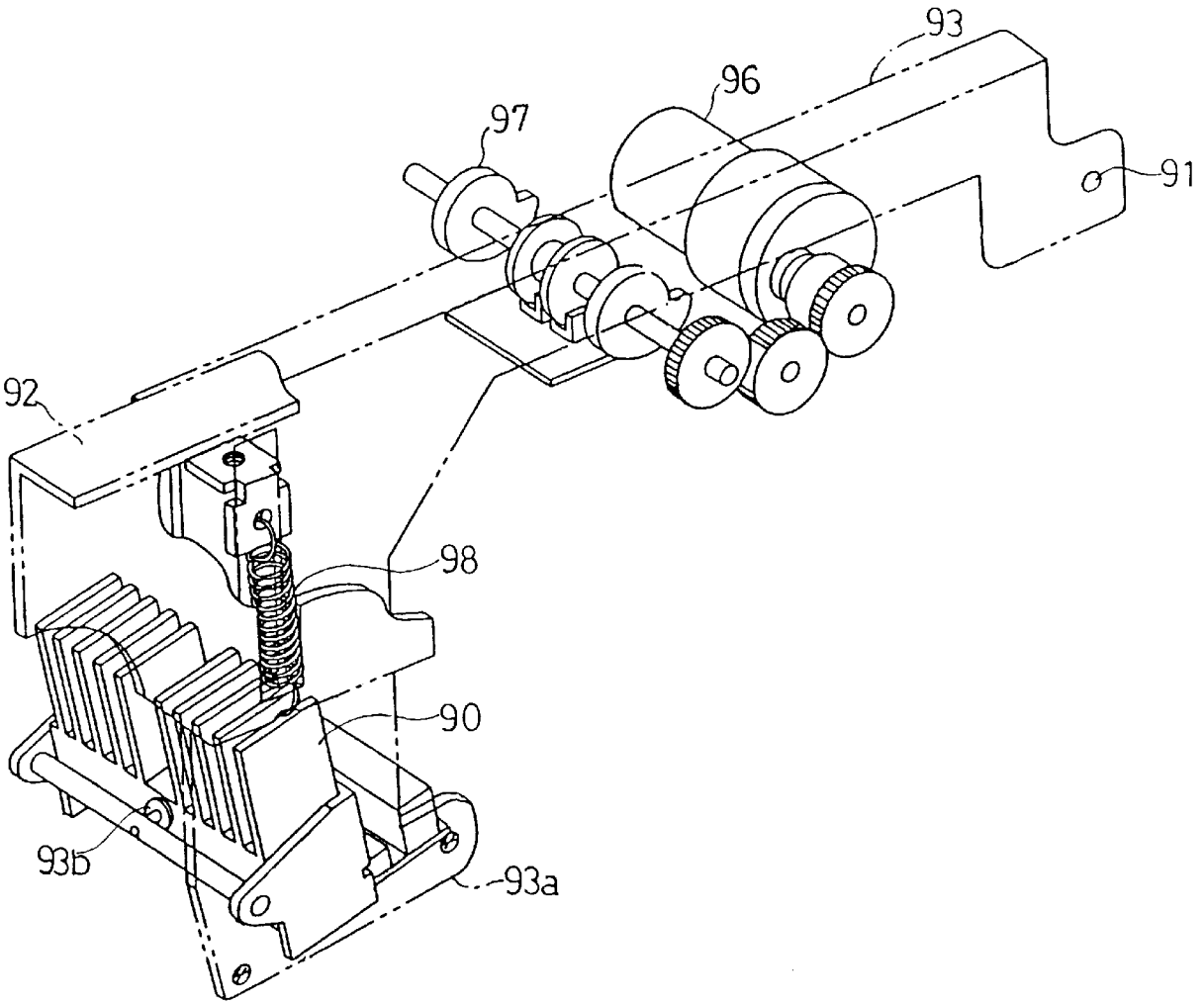
FIG. 14 is a perspective view of principal parts of a modified printhead support member.

For causing the printhead 90' to pivot laterally in the manner described above, it is also possible, as shown in FIG. 14, to mount the printhead 90' on the printhead support arm 93 via a shaft 93*b* oriented in the front-rear direction so that the printhead is free to pivot up to a predetermined extent.

Referring back to FIG. 1, the box-shaped printhead support member 93*a* at the front portion of the printhead support arm 93 has a front wall portion 93*a*'. This front wall portion is provided with a pair of right and left hook levers 100 elastically retractably movable. The hook levers are for holding a ribbon guide roller 99 described hereinafter by coming into snapping engagement with the same roller. The chassis frame 1 has suitable right and left portions each for supporting a bracket 101. The bracket is formed with a guide slot 101*a* for supporting one of the ends of the ribbon guide roller 99 in a slidable manner. The guide slot 101*a* vertically extends by a predetermined distance, while it deviates forward as viewed upward.

As already described, the ribbon cartridge 15 is supported by the printer housing. The ribbon cartridge 15 includes a rearward ribbon supply roll 15*a* and a forward ribbon winding roll 15*b*. The ink ribbon R unwound from the ribbon supply roll 15*a* is rewound by the ribbon winding roll 15*b*. The ink ribbon R includes regions for formation of a yellow ink layer, a magenta ink layer and a cyanine ink layer, and if necessary a black ink layer, in this order. These regions are repetitively arranged longitudinally of the ink ribbon. Each region has a sufficient length for impressing a print on one card. The starting point of the yellow ink layer region is formed with a marker which is detectable by a photosensor 102 for example. The winding roll 15*b* is associated with a motor (not shown) whose rotation is controllable. In this arrangement, the ink ribbon is fed in accordance with the relative movement of the card on the card carrier table 60 for impressing a print in each color. Further, the ink ribbon is fed for each printing cycle until the starting point or the marker is detected.

When the open-close lid 12 is closed with the ribbon cartridge 15 mounted on the housing, the polygon member 92*a* of the printhead housing 92, the printhead support portion 93*a* located within the polygon member, and the printhead 90' mounted on the printhead support portion are lowered to be inserted between the ribbon supply roll 15*a* and the ribbon winding roll 15*b* of the ribbon cartridge 15. In this way, the ink ribbon R bridging between the ribbon supply roll 15*a* and the ribbon winding roll 15*b* comes into contact with the bottom surface of the printhead 90'. Further, the hook lever 100 comes into snapping engagement with the ribbon guide roller 99 for holding the same guide roller near the front wall of the box-shaped printhead support portion 93*a*. Thus, after the ink ribbon R passes the bottom surface of the thermal printhead 90', the ink ribbon goes upward along the front wall of the box-shaped printhead support portion 93*a*, engages the ribbon guide roller 99 and then is rewound by the ribbon winding roll 15*b*.

In such an arrangement, the marker on the ink ribbon R is reliably detected when the photosensor 102 is located ahead but close to the lower portion of the front wall of the box-shaped printhead support member 93*a* or the thermal printhead 90'. In this way, the starting point of the ink ribbon R for each printing cycle can be set at a position adjacent to the thermal printhead 90'. Thus, the longitudinal length of each color region on the ink ribbon can be minimized and the ink ribbon is effectively consumed. In other words, for an ink ribbon having a certain length, each color region used for one printing operation is longitudinally reduced in length and therefore the number of possible printing operations is increased.

Further, a pressing roller 110 is provided at a position which is not ahead of the polygon member 92*a* of the housing 92. The pressing roller is supported at its both ends by the chassis frame 14 for vertical movement. This vertical movement may be realized by a solenoid (not shown). The pressing roller 110, when brought to a lowered position, presses the rear portion of the card K onto the table surface 60*a* of the card carrier table 60 under a predetermined pressure.

The portion at which the photosensor 102 is located for detection of the marker on the ink ribbon is also provided with a photosensor 103 for detection of the leading edge of the card K fed by the card supply mechanism 20.

The printer housing 11 has a forward region provided with a card discharge mechanism 120 for discharging the card which is held on the card carrier table 60 and finished with the printing operations with the printhead 90'. As shown in FIG. 1, the card discharge mechanism 120 can pivot about a shaft 122 and basically includes a card pick up guide plate 123 extending rearward and a roller support arm 125. The roller support arm can pivot about the shaft 122 and supports two feed rollers 124, 124 spaced in the front-rear direction. The roller support arm 125 is constantly urged downward by an unillustrated spring, so that the respective feed rollers 124, 124 press the card pick up guide plate 123 with a proper pressure.

In a normal state, the guide plate 123 is held at a higher position than the reciprocative card carrier table 60 to avoid interference therewith. However, when the card is about to be discharged, that is, when the leading edge of the card K is lifted by the projection pins 67 and the card carrier table 60 further proceeds, the pick up guide plate 123 is held at a lowered position so that the rear end 123*a* of the guide plate is inserted between the lifted leading edge of the card and the table surface 60*a* (see FIGS. 20 and 21). The downward movement of the pick up guide plate 123 may be realized by an unillustrated solenoid for example.

Next, description is given to a method of holding the card K with respect to the card carrier table, and a printing operation for the card K by the thermal printhead 90. It is assumed that the card used here is rather thick.

Figure 15:
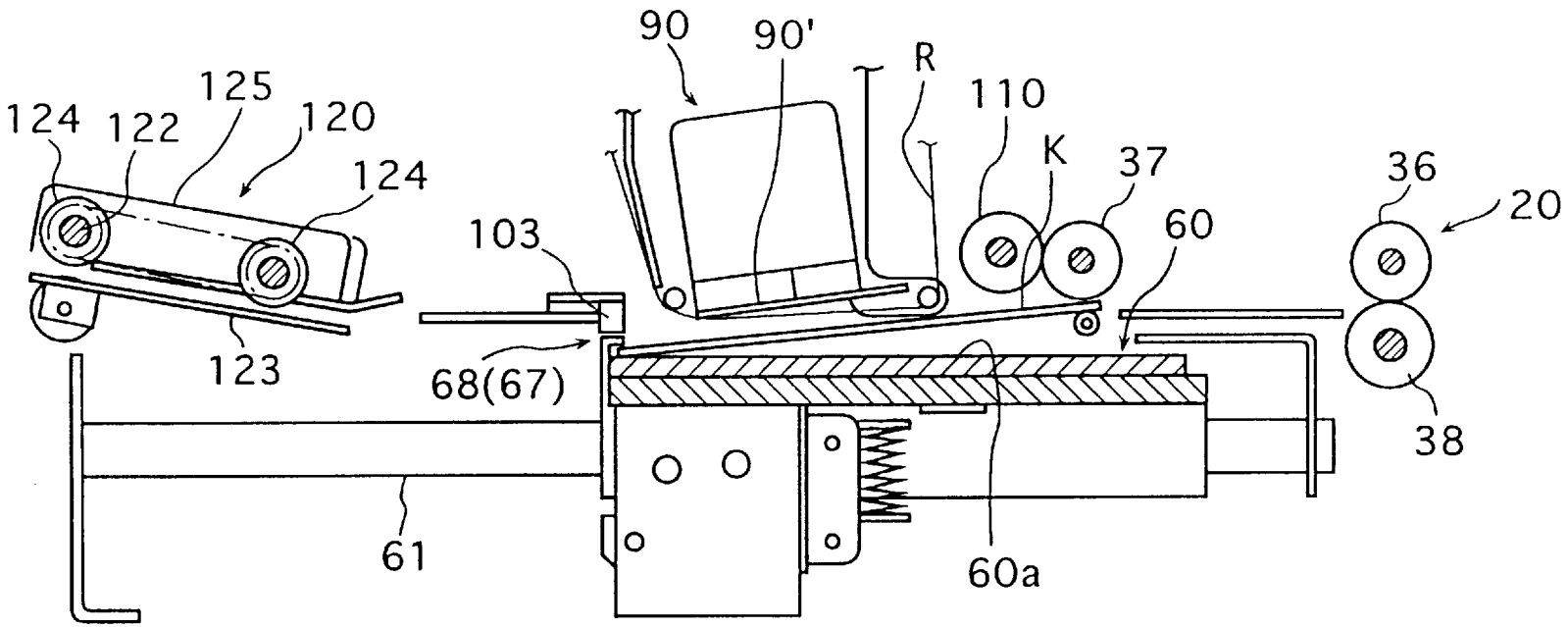
FIG. 15 illustrates a printing operation, in which the card carrier table is located at a home position. The clamp claw and the positioning piece assume the first state (FIG. 9), projecting from the table surface, to wait for a card to be supplied from the card supply mechanism. After the card is supplied, the positioning piece comes into contact with the leading edge of the card to position the card.

In a card waiting state shown in FIG. 15, the card carrier table 60 assumes a home position. When viewed in the front-rear direction, the position of the card carrier table 60 located at the home position is so adjusted that the distance between the second feed roller 37 of the card supply mechanism 20 and the front end of the table surface 60*a* is slightly smaller to a proper extent than the overall length of the card. The photosensor 103 for detection of the leading edge of the card K is arranged to detect the arrival of the leading edge of the card K at the front end of the table surface 60*a* of the card carrier table 60 located at the home position. It is possible to bring the card carrier table 60 to the home position by stopping the motor 65 when a shielding plate 60*b* provided at a suitable portion of the card carrier table 60 blocks a photo-interrupter (FIG. 1) provided at a suitable portion of the chassis frame 14. The card carrier table 60 can be moved as required in the front-rear direction from the home position by controlling the motor 65. The control of the motor is performed based on the current position of the card carrier table 60 which is substantially detected by signals from a rotation encoder associated with the motor.

When the card carrier table 60 assumes the home position, the clamp claws 68 and the projection pins 67 assume the first state shown in FIG. 9. Specifically, the clamp claws 68, 68 are caused to project to overhang the leading edge of the table surface 60*a*, while the adjacent positioning pieces 69, 69 are caused to project from the table surface 60*a*. However, the projection pins 67 are pulled below from the table surface 60*a*. The thermal printhead 90' is assuming a raised position spaced from the table surface 60*a*. The ink ribbon is wound in a ready state for a first printing cycle. The pressing roller 110 is assuming a raised position.

Figure 16:
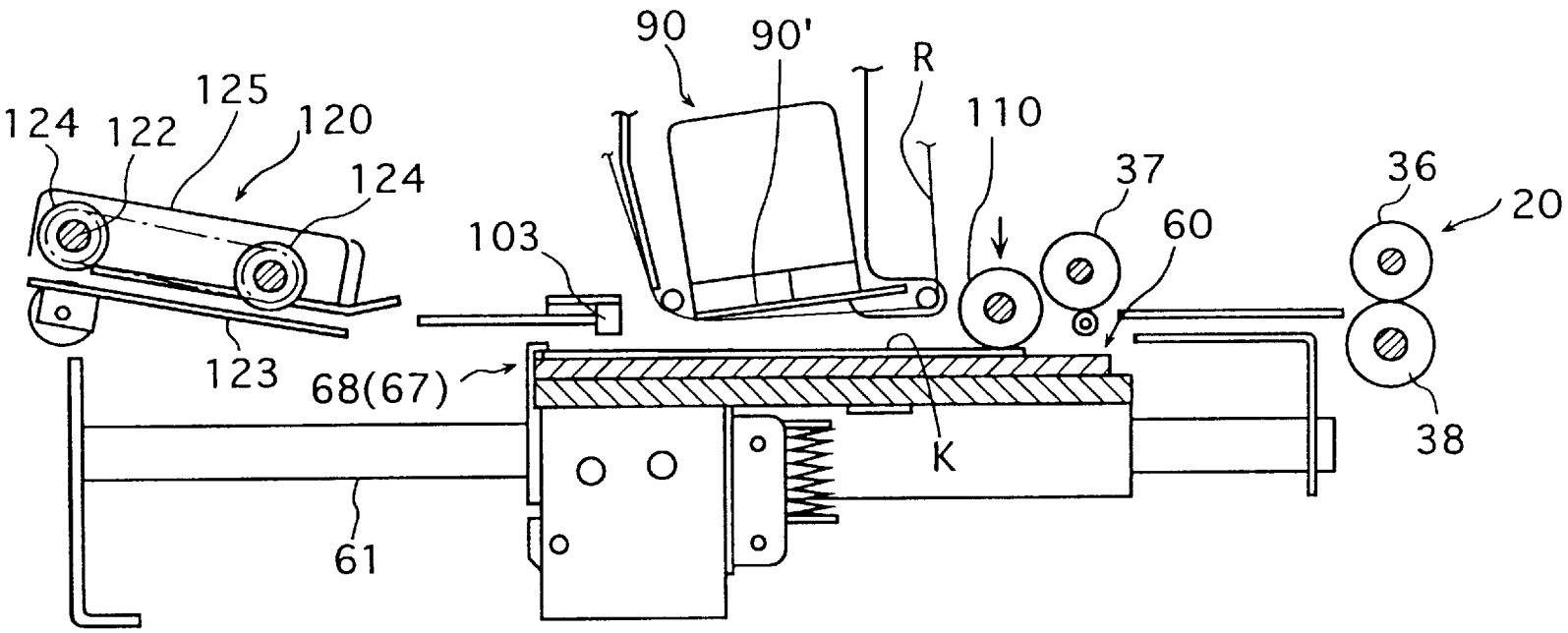
FIG. 16 illustrates the printing operation, in which the card carrier table is moved forward from the home position shown in FIG. 15, whereas the clamp claw and the positioning piece assume the second state (FIG. 10) to clamp the card against the table surface.
Figure 17:
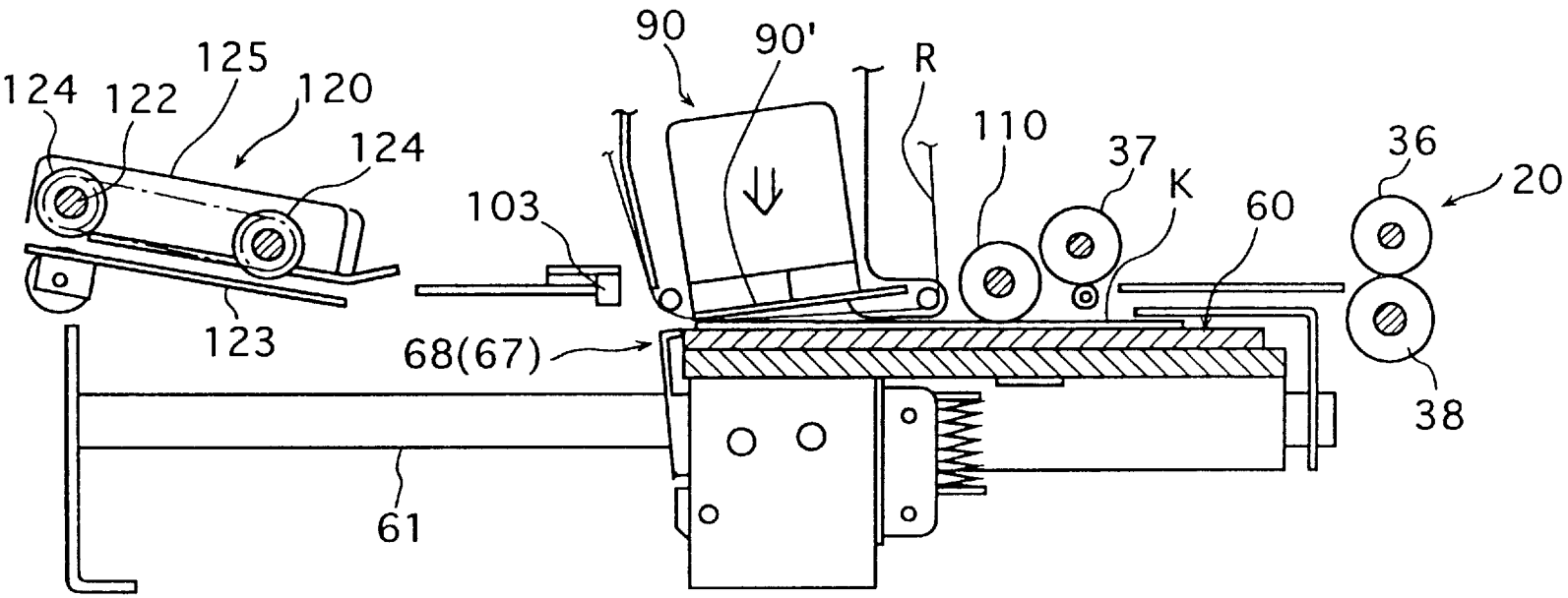
FIG. 17 illustrates the printing operation, in which the card carrier table is moved rearward from the position shown in FIG. 16 so that the leading edge of the card corresponds in location to a heating dot array of the printhead. At this stage, the clamp claw and the positioning piece assume the third state (FIG. 12) to release the clamp of the leading edge of the card, thereby enabling the printhead to impress a print from the leading edge of the card. The printhead is lowered to contact the leading edge of the card. Thereafter, a printing operation using a predetermined color is performed while the card carrier table is being moved forward.

After the card K is fed forward from the card supply mechanism 20, the leading edge of the card is placed between the clamp claws 68, 68 and the table surface 60*a*, and directly contacted by the right and left positioning pieces 69, 69 for the positioning on the table. At this time, the photosensor 103 detects the leading edge of the card K. In accordance with the detection signals, the card carrier table 60 is caused to move forward from the home position in synchronism with the card feeding speed of the card supply mechanism 20, and simultaneously the clamp claws 68, 68 are caused to firmly clamp the leading edge of the card K against the table surface 60*a*. (The second state. See FIG. 10.) The present forward movement of the card carrier table 60 continues until the trailing edge of the card K leaves the second intermediate feed roller 37 as shown in FIG. 16. When the card K is entirely retained on the table surface, the card carrier table 60 reverses the direction of movement and begins to move rearwardly. During the rearward movement, the pressing roller 110 is lowered, as shown in FIG. 16, to press the rear end of the card K onto the table surface 60*a*. Then, when the card carrier table 60 moves rearward and arrives at a point near the end of the backward movement (back to the point shown in FIG. 1), the clamp claws 68, 68 moves forwardly, as shown in FIG. 17, to leave the upper front portion of the card K. (The third state. See FIG. 12.)

Then, as shown in FIG. 17, the thermal printhead 90' is lowered to contact the upper front portion of the card K. While this contacting state is being maintained, the card carrier table 60 is caused to move forwardly so that a print in yellow is impressed. As already described, the leading edge of the card K is now out of engagement with the clamp claws 68, 68 which have been brought forwardly. Thus, there is no interference between the thermal printhead 90' contacting the leading edge of the card K and the clamp claws 68, 68. Therefore, it is possible to impress a print over the entire surface of the card K. While the clamp claws 68, 68 are kept spaced forward at the time of impressing a print for the leading edge of the card, the pressing roller 110 is pressed onto a rearward portion of the card. Thus, it is possible to prevent the card K from unduly deviating during the printing operation.

Figure 18:
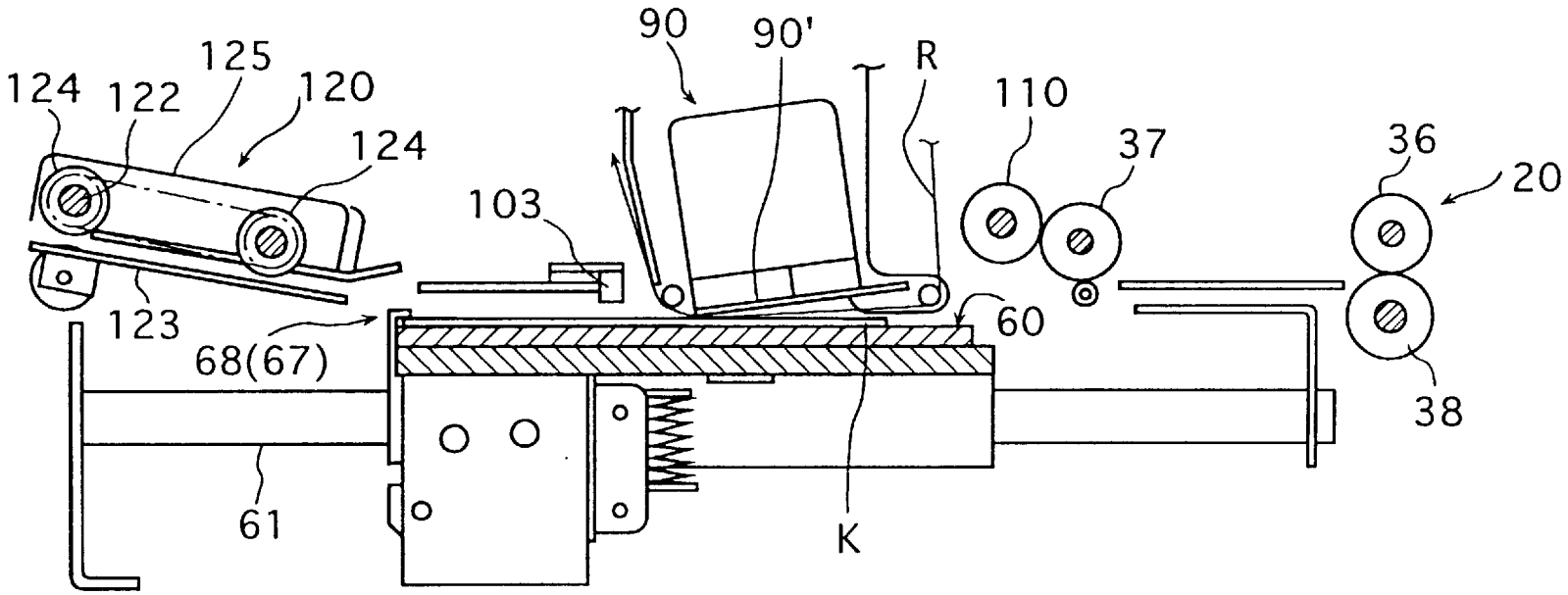
FIG. 18 illustrates the printing operation, in which the card carrier table is moved forward from the position shown in FIG. 17. At this stage, the clamp claw and the positioning piece, since they do not interfere with the printhead, assume the second state (FIG. 10) again to clamp the leading edge of the card.

When the card carrier table 60 are advanced to a certain extent where there is no possibility of interference between the clamp claws 68, 68 and the printhead 90', the clamp claws 68, 68 are brought back, as shown in FIG. 18, to clamp the leading edge of the card K. (The second state. See FIG. 8.) Then, when the card carrier table 60 is further advanced and the printing operation is performed for a rearward portion of the card K, the pressing roller 110 does not press the card K and therefore assumes a raised position, as shown in FIG. 18.

Figure 19:
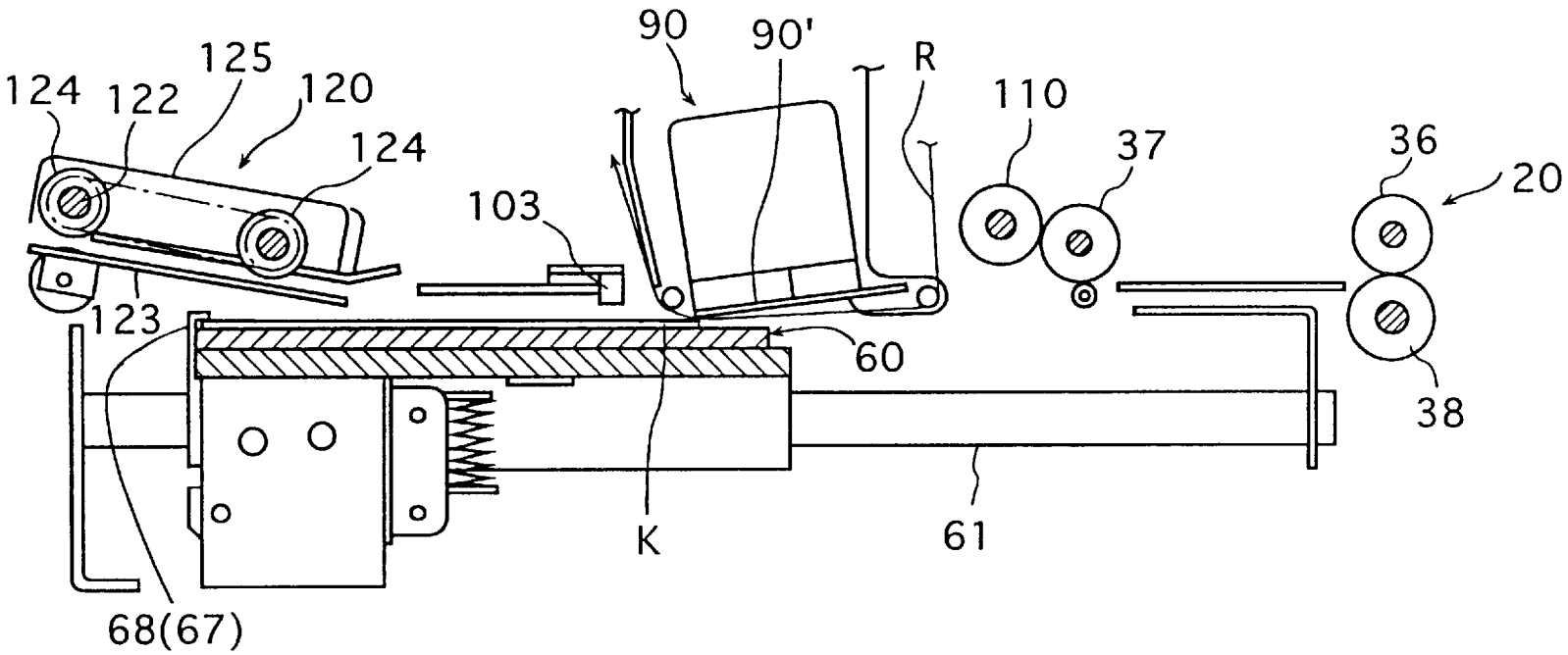
FIG. 19 illustrates the printing operation, in which the card carrier table is advanced to a front extremity, and the printhead contacts the trailing edge of the card to perform printing.
Figure 20:
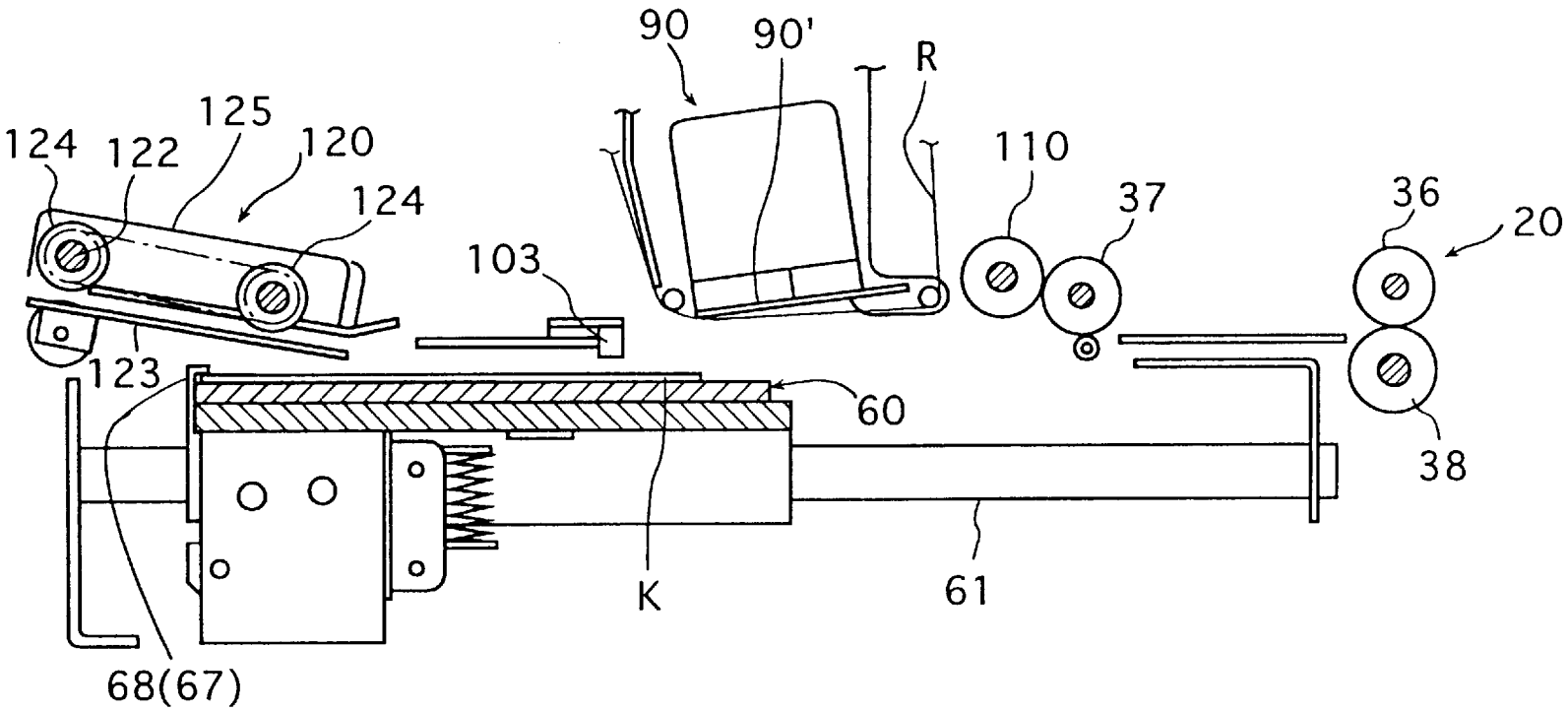
FIG. 20 illustrates the printing operation, in which the printhead is raised from the state shown in FIG. 19. The height of the printhead at this stage is greater than those shown in FIGS. 15 and 16, so that the ink ribbon is reliably detached from the card surface.

When the yellow printing is finished as shown in FIG. 19, the printhead 90' is raised as shown in FIG. 20, while the card carrier table 60 is moved back to the rearward position in the same manner as described above. Preferably, the upward movement of the printhead 90' upon completion of the printing operation for the rear end of the card K should be continued until the printhead is raised high enough so that the ink ribbon R adhered to the card surface will come off. In that case, the feeding of the ink ribbon R is more smoothly performed. After the ink ribbon R is detached from the card surface, the printhead is caused to assume a standby state slightly spaced from the card surface in preparation for the next printing operation (using the next color).

Figure 21:
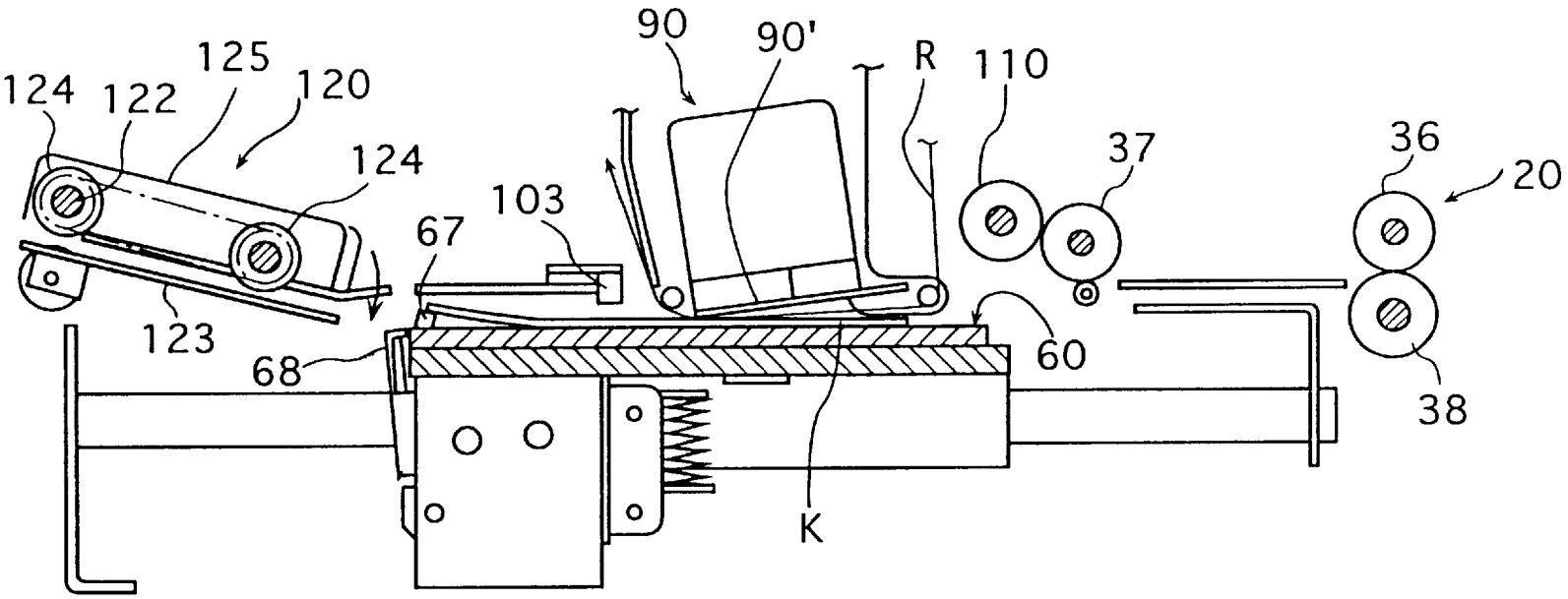
FIG. 21 illustrates the printing operation, depicting a state where the printing operation in an overlapping manner is almost finished for printing the last color. At this stage, the fourth state (FIG. 13) is assumed where the clamp claw and the positioning piece are moved forward, whereas the lifting pin projects from the table surface to raise the leading edge of the card from the table surface. A this time, the card discharge mechanism assumes a lowered position.

Similarly thereafter, respective printing operations using magenta and cyanine, and if necessary black, are performed in an overlapping manner. However, when the printing operation using black comes close to an end as shown in FIG. 21, the clamp claws 68, 68 are moved forward to release the clamping engagement with the leading edge of the card K, and the projection pins 67 are caused to project from the table surface 60*a* to raise the leading edge of the card K. (The fourth state. See FIG. 13.) Thus raised leading edge of the card K is picked up by the card discharge mechanism 120 and the card is discharged via a front discharge slot 121 of the printer 10.

Figure 22:
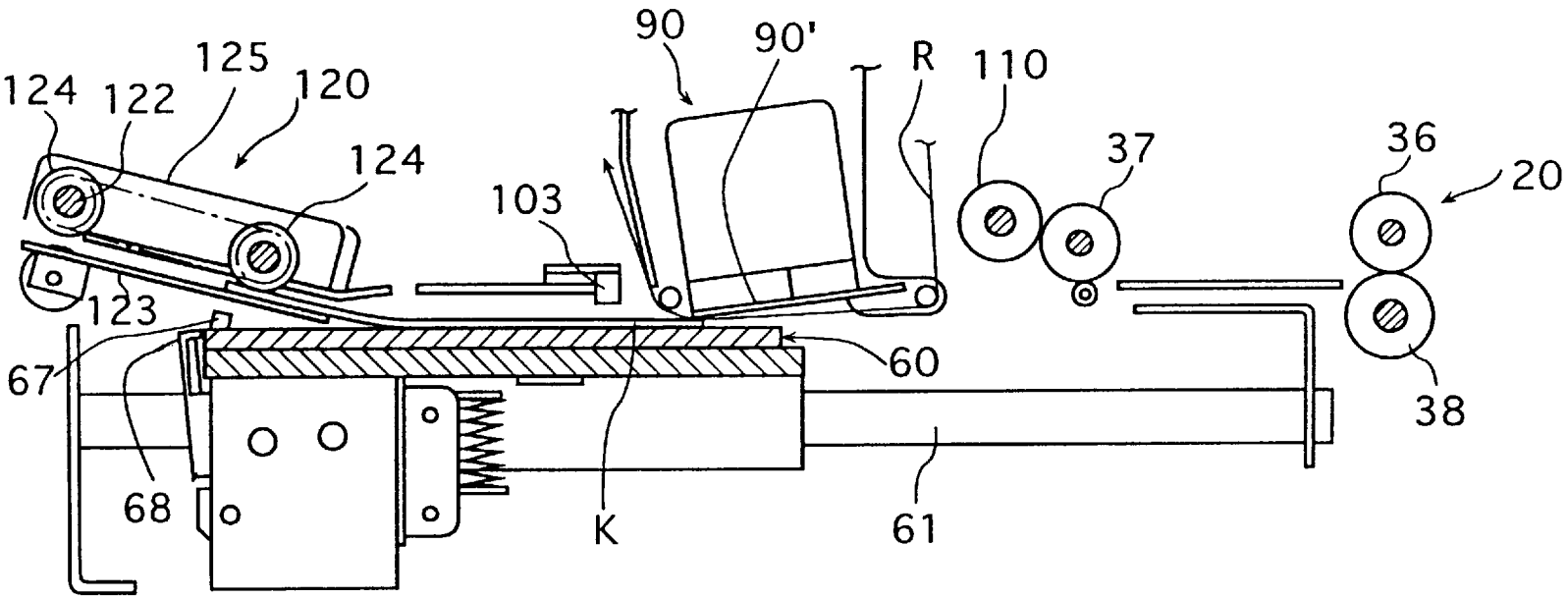
FIG. 22 illustrates the printing operation, in which the card carrier table is further advanced compared to the state shown in FIG. 21. A card pick up guide plate of the card discharge mechanism picks up the leading edge of the card raised from the table surface as previously described and then a feed roller sends the card to an outlet.

More specifically, in impressing color prints in an overlapping manner, when the card carrier table 60 is moved forward to finish the last color printing operation, the card discharge mechanism 120 assumes the lowered position as shown in FIG. 21. In this state, when the card carrier table 60 is moved forward together with the card K whose leading edge is raised by the projection pins 67, the card pick up guide plate 123 picks up the leading edge of the printed card K, as shown in FIG. 22. Then, as the card carrier table 60 moves forward, the leading edge of the card K thus picked up moves forward along the upper surface of the card pick up guide plate 123 to be inserted between the card pick up guide plate 123 and the feed rollers 124, 124. When the leading edge of the card K is advanced therebetween to a certain extent, the feed rollers 124, 124 force the card K forward to discharge the card via the discharge slot 121.

The arrangements of the card printer according to the present invention and printing methods using the card printer being thus described, it is obvious that the scope of the present invention is not limited to the embodiments described above, and any modifications or alterations made within the scope of respective attached claims are intended to be included in the scope of the present invention.

In the above embodiments, for a color printing method, a sublimation type ink ribbon is used and Y, M, C and B are printed in an overlapping manner. However, B may not be used. Further, depending on the material of the card to be used, a coating layer may be formed on the card before the printing operation using Y is performed, so that adhesion of the sublimation type ink is facilitated. Further, a protection layer may be formed after the printing operation using B is performed. The formation of the coating layer and the protection layer is possible in either case by using a thermal printhead capable of thermally transferring a layered material carried on the ink ribbon onto the card surface.

Further, in the printing method described above, use of a rather thick card K is premised, and the clamping means 65 is designed to assume the non-clamping position when printing is performed about the leading edge of such a card. However, in a case where a thin card or sheet is used and hence causing the clamping means to assume the non-clamp position is not recommendable, it is also possible, without departing from the scope of the present invention, to arrange that the clamping means 65 remains in the clamp position while the printing operation is being performed. In using a thin card, it is preferable that the leading edge of the card remains clamped while the printhead held in contact with the card is moved from front to rear. In such an instance, the leading edge of the card or sheet is preferably always clamped.

In any case, it is possible to cause the clamping means to properly clamp the leading edge of the card against the table surface, regardless of the thickness of the card. Thus, even when different kinds of cards are used, a desired color printing operation is performed without any problem.

Further, in the embodiments described above, the card supply mechanism and the card discharge mechanism are both arranged to adapt to variation in card thickness. Therefore, the card printer according to the above embodiment, as a whole, is capable of adapting to variation in card thickness.

I claim:

1. A card printer comprising:

a card supply mechanism for forwardly feeding cards one after another from a stack thereof held by a card stocker;

a card carrier table having an upper surface for supporting each of the cards fed from the card supply mechanism, the card carrier table being reciprocatively movable forwardly and rearwardly;

a printhead located above the card carrier table, the printhead selectively assuming a position contacting said each card on the card carrier table via an ink ribbon and a position upwardly spaced from said each card;

a card discharge mechanism for picking up a printed card from the card carrier table moved to a forward position and for discharging the printed card;

clamping means for positioning said each card fed from the card supply mechanism by contacting a leading edge of said each card, the clamping means selectively assuming a clamping position to clamp the leading edge of the card and a non-clamping position by moving forward away from the clamping position;

a pressing roller arranged behind the printhead, the pressing roller selectively assuming a position for pressing a rear portion of an upper surface of the card on the card carrier table, and a position upwardly spaced from the card;

means for moving forward the clamping means from said each card in the non-clamping position; and means for pressing the pressing roller onto the upper surface of said each card when the clamping means assumes the non-clamping position and the printhead is spaced from the upper surface of the card.

2. The card printer according to claim 1, wherein the card supply mechanism includes an initial feed roller for forwardly feeding the cards one after another from the card stocker accommodating the stacked cards, and a plurality of intermediate feed rollers arranged ahead of the initial feed roller to face a card transfer path from above and below, part or all of the intermediate feed rollers being movable transversely of the card transfer path and urged toward the card transfer path.

3. The card printer according to claim 2, wherein the stacked cards accommodated within the card stocker are constantly urged upward, the initial feed roller contacting a surface of an uppermost card of the stacked cards and rotating in a forward direction to feed the uppermost card forwardly.

4. The card printer according to claim 3, wherein the intermediate feed rollers provided ahead of the initial feed roller are disposed at two positions located above the card transfer path and spaced to each other in a front-rear direction, the intermediate feed rollers being respectively mounted on front and rear portions of a second arm, the second arm being pivotally supported at an intermediate portion thereof by a suitable portion of a first arm pivotally supported by a frame and urged downward.

5. The card printer according to claim 2, wherein the card supply mechanism is arranged so that no forward feed driving force is given to the initial feed roller after a card fed by the initial feed roller is released from the initial feed roller.

6. The card printer according to claim 5, wherein, in the card supply mechanism, the initial feed roller is supported for forward one-way rotation by a feed roller shaft to which forward and reverse rotational driving forces are given, the card supply mechanism further including:

a forward one-way gear and an adjacent reverse one-way gear mounted on an end of the feed roller shaft;

an idle gear held in mesh with the forward one-way gear;

an intermediate transmission shaft carrying an intermediate transmission gear held in mesh with both the idle gear and the reverse one-way gear;

pulleys attached to roller shafts carrying the respective intermediate feed rollers provided at said two positions;

a pulley mounted on the intermediate transmission shaft; and an endless belt held in engagement with the above pulleys so that the respective pulleys rotate in a same direction.

7. The card printer according to claim 6, wherein a predetermined frictional resistance is present between the feed roller and the feed roller shaft carrying the feed roller for forward one-way rotation.

8. The card printer according to claim 7, further comprising a reverse gear held in mesh with the idle gear and a reverse roller mounted on a reverse shaft supporting the reverse gear for rotational movement with a predetermined frictional resistance, the reverse roller being arranged below the transfer path to contact a lower surface of a card fed along the transfer path.

9. The card printer according to claim 1, wherein the printhead is attached to a printhead support member movable in an up-down direction, the printhead support member being arranged to urge the printhead toward said each card by downward elastic force when the support member descends.

10. The card printer according to claim 9, wherein the printhead support member is provided with a ribbon guide roller for guiding an ink ribbon after the ink ribbon passes a head surface of the printhead.

11. The card printer according to claim 10, wherein the printhead support member or the printhead is mounted on an open-close member, the ribbon guide roller being supported by a bracket attached to a chassis frame for vertical movement by a predetermined distance, the printhead support member being formed with a hook member held in snapping engagement with the ribbon guide roller when the open-close member is closed, thereby causing the ribbon guide roller to be held at a predetermined position relative to the printhead support member.

12. The card printer according to claim 11, wherein the ink ribbon is fed from a rear side of the printhead to a front side of the printhead, the printhead support member being formed with a front wall ahead of the printhead, the ribbon guide roller coming into engagement with the ink ribbon after the ink ribbon passes the head surface of the printhead and moves upward along the front wall.

13. The card printer according to claim 12, wherein a photosensor is provided in facing relation to the front wall of the printhead support member for detection of a marker formed on the ink ribbon.

14. The card printer according to claim 1, wherein the printhead is attached to a printhead support member movable in an up-down direction, the printhead being pivotable laterally for coming into uniformly pressing contact with said each card on the card carrier table via an entire lateral length of the printhead.

15. The card printer according to claim 14, wherein the printhead support member is formed with a forwardly extending arm portion torsionally deformable in an elastic manner to allow the printhead to pivot laterally.

16. The card printer according to claim 14, wherein the printhead is carried by the printhead support member for pivotal movement about an axis extending in a front-rear direction.

17. The card printer according to claim 1, wherein the card carrier table further comprises card lifting means for lifting the leading edge of the printed card from the carrier table by the projecting of the lifting means from the carrier table when the carrier table is moved to a forward position after a printing operation is completed.

18. The card printer according to claim 17, wherein the card discharge mechanism includes: pick-up means having a scooping member for picking up the printed card from the card carrier table in a manner such that the scooping member is moved forward after the scooping member is inserted between the leading edge of the printed card and the upper surface of the card carrier table, the leading edge of the printed card being lifted up by the card lifting means on the card carrier table when the card carrier table is moved to the forward position; and transfer-discharge means for carrying forward the picked up card and for discharging the same card.

19. A method of printing on cards using a card printer which includes:

a card supply mechanism for forwardly feeding cards one after another from a stack thereof held by a card stocker;

a card carrier table having an upper surface for supporting each of the cards fed from the card supply mechanism, the card carrier table being reciprocatively movable forwardly and rearwardly;

a printhead located above the card carrier table, the printhead selectively assuming a position contacting said each card on the card carrier table via an ink ribbon and a position upwardly spaced from said each card; and a card discharge mechanism for picking up a printed card from the card carrier table moved to a forward position and for discharging the printed card;

the card carrier table being provided with clamping means for positioning said each card fed from the card supply mechanism by contacting a leading edge of said each card, the clamping means selectively assuming a clamping position to clamp the leading edge of said each card and a non-clamping position by moving forward away from the clamping position;

the card printer further comprising a pressing roller arranged behind the printhead, the pressing roller selectively assuming a position for pressing a rear portion of an upper surface of said each card onto the card carrier table and a position upwardly spaced from said each card;

the method, in which the card carrier table with said each card carried on the upper surface of the table is reciprocated forwardly and rearwardly, comprising the steps of:

impressing a print on said each card from the leading edge toward a trailing edge of said each card with the printhead held in contact with said each card via the ink ribbon when the card carrier table is moved forward;

keeping the printhead away from said each card when the card carrier table is moved backward; and repeating the above two steps a plurality of times;

wherein the clamping means moves forward to assume the non-clamping position at least during a predetermined period when the card carrier table is moving forward after moved backward; and wherein the pressing roller presses said each card when the clamping means assumes the non-clamping position and the printhead is kept spaced from said each card.

20. The method of printing on cards according to claim 19, wherein said above two steps are repeated a plurality of times for successively impressing a print in Y(yellow), M(magenta) and C(cyanine), and if necessary B(black).

21. The method of printing on cards according to claim 20, further comprising the step of applying a coating material prepared in a predetermined region of the ink ribbon to the card or sheet by the printhead before printing operations using Y(yellow), M(magenta) and C(cyanine), and if necessary B(black), are performed.

22. The method of printing on cards according to claim 19, wherein the printhead is lifted up by a predetermined distance for detaching the ink ribbon from the card or sheet after the card carrier table is moved forward for impressing a print on the card by the printhead.

* * * * *